US010852676B2

(12) United States Patent
Momiyama

(10) Patent No.: US 10,852,676 B2
(45) Date of Patent: Dec. 1, 2020

(54) IMAGE FORMING APPARATUS

(71) Applicant: CANON KABUSHIKI KAISHA, Tokyo (JP)

(72) Inventor: Daisuke Momiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/411,705

(22) Filed: May 14, 2019

(65) Prior Publication Data

US 2019/0354045 A1 Nov. 21, 2019

(30) Foreign Application Priority Data

May 18, 2018 (JP) ..... 2018-096657

(51) Int. Cl.
*G03G 15/20* (2006.01)
*G03G 15/00* (2006.01)

(52) U.S. Cl.
CPC ..... *G03G 15/205* (2013.01); *G03G 15/2053* (2013.01); *G03G 15/2064* (2013.01); *G03G 15/5004* (2013.01)

(58) Field of Classification Search
CPC ..... G03G 15/205; G03G 15/2053; G03G 15/2064; G03G 15/5004; G03G 15/2042
See application file for complete search history.

(56) References Cited

U.S. PATENT DOCUMENTS

2018/0004134 A1* 1/2018 Nomura ..... G03G 15/2017

FOREIGN PATENT DOCUMENTS

JP 2015-099180 A 5/2015

* cited by examiner

*Primary Examiner* — Erika J Villaluna
(74) *Attorney, Agent, or Firm* — Venable LLP

(57) ABSTRACT

When an excess period, which is period in which the total of the power predicted by a power predicting unit and power stored by a power storing unit exceeds a predetermined power, exists during continuous feeding, the power supply to a plurality of heating elements by an power control unit is adjusted so that the total of the power supplied to the plurality of heating elements and power stored by the power storing unit does not exceed the predetermined power at least during the excess period, and, after the excess period, the transport interval is adjusted so that the temperature rising to a target temperature of the plurality of heating regions by supplying power in which the adjustment is cancelled is completed before the arrival of the recording material to the fixing portion.

11 Claims, 21 Drawing Sheets

(1)

IMAGE FORMING APPARATUS

BACKGROUND OF THE INVENTION

Field of the Invention

The present invention relates to an image forming apparatus, such as a printer, a copier and a facsimile, utilizing an electrophotographic system. The present invention also relates to an image heating apparatus, such as a gloss applying apparatus that improves a gloss value of a toner image by reheating a fixing unit included in an image forming apparatus and a toner image fixed to a recording material.

Description of the Related Art

Lately the power consumed by an image forming apparatus is increasing as the processing speed of an image forming apparatus increases. In particular, in the case of a high-speed color laser printer which simultaneously forms a plurality of toner image, a drive apparatus, including a motor, consumes a large amount of current. In order to output stable fixed images by such an image forming apparatus, a configuration to change printing productivity (hereafter "throughput"), which is a number of prints per unit time, was proposed in Japanese Patent Application Publication No. 2015-099180. In other words, the apparatus environment, the temperature state of the fixing unit, and the load state of the printer are detected, and when it is determined that the current required for the image forming operation exceeds the maximum current that can be supplied by the AC power supply, a control to increase the transport interval of the recording paper in the initial period of printing is performed.

SUMMARY OF THE INVENTION

However, the configuration of the above mentioned prior art was designed to supply the necessary fixing power to the image forming apparatus, of which the AC power voltage, ambient temperature and load are within a standard range, and did not have sufficient margin to the maximum supply power of the AC power supply to meet the tendency of an increase in the power consumption of the image forming apparatus. Therefore if a replenishing motor or an actuator for a stapling operation are driven during printing, the maximum power may be exceeded. If an operation to drop throughput in general is performed when such an operation as driving a motor or an actuator during printing is performed, usability may be considerably diminished.

It is an object of the present invention to provide an image forming apparatus that can minimize the drop in throughput even if a control to apply power load, such as a driving of a motor and stapling operation, is performed during printing.

To achieve this object, the image forming apparatus of the present invention includes:

an image forming portion which is configured to form an image on a recording material;

a fixing portion which includes a heater constituted of a plurality of heating elements disposed in a direction orthogonal to a transport direction of a recording material, and is configured to fix the image on the recording material using heat of the heater; and an power control unit which is configured to be capable of controlling power supplied to the plurality of heating elements individually based on image information of an image formed on a recording material, wherein the image forming apparatus further comprises:

an interval determining unit that is configured to determine a transport interval of a plurality of recording materials in the case of continuous feeding in which images are continuously formed on the plurality of recording materials and the images are continuously heated;

an actuator which is configured to operate during the continuous feeding;

a power predicting unit which is configured to predict power required for controlling the temperature of a plurality of heating regions heated by the plurality of heaters to a predetermined target temperature based on the image information;

a power storing unit which is configured to store power required for operating the actuator; and an adjusting unit which is configured for adjusting the power supplied to the plurality of heating elements by the power control portion, and the transport interval determined by the interval determining unit, wherein when an excess period, which is a period in which the total of the power predicted by the power predicting unit and power stored by the power storing unit exceeds a predetermined power, exists during continuous feeding, the adjusting unit: (i) at least during the excess period, adjusts power supplied to the plurality of heating elements by the power control unit, so that the total of the power supplied to the plurality of heating elements and the power stored by the power storing unit does not exceed the predetermined power, and (ii) after the excess period, adjusts the transport interval so that the temperature rising to a target temperature in the plurality of heating regions by supplying power to the plurality of heating regions in which the adjustment of the power supply is cancelled, is completed before the arrival of the recording material to the fixing portion.

According to the present invention, a margin of power is calculated based on the required power predicted from the image information of each heating element, and an optimum print interval is determined based on the newly applied power load even if a control to apply power load, such as a driving of a motor and stapling operation, is performed during printing. Thereby a drop in throughput can be minimized.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Overview of Image Forming Apparatus

Figure 1:
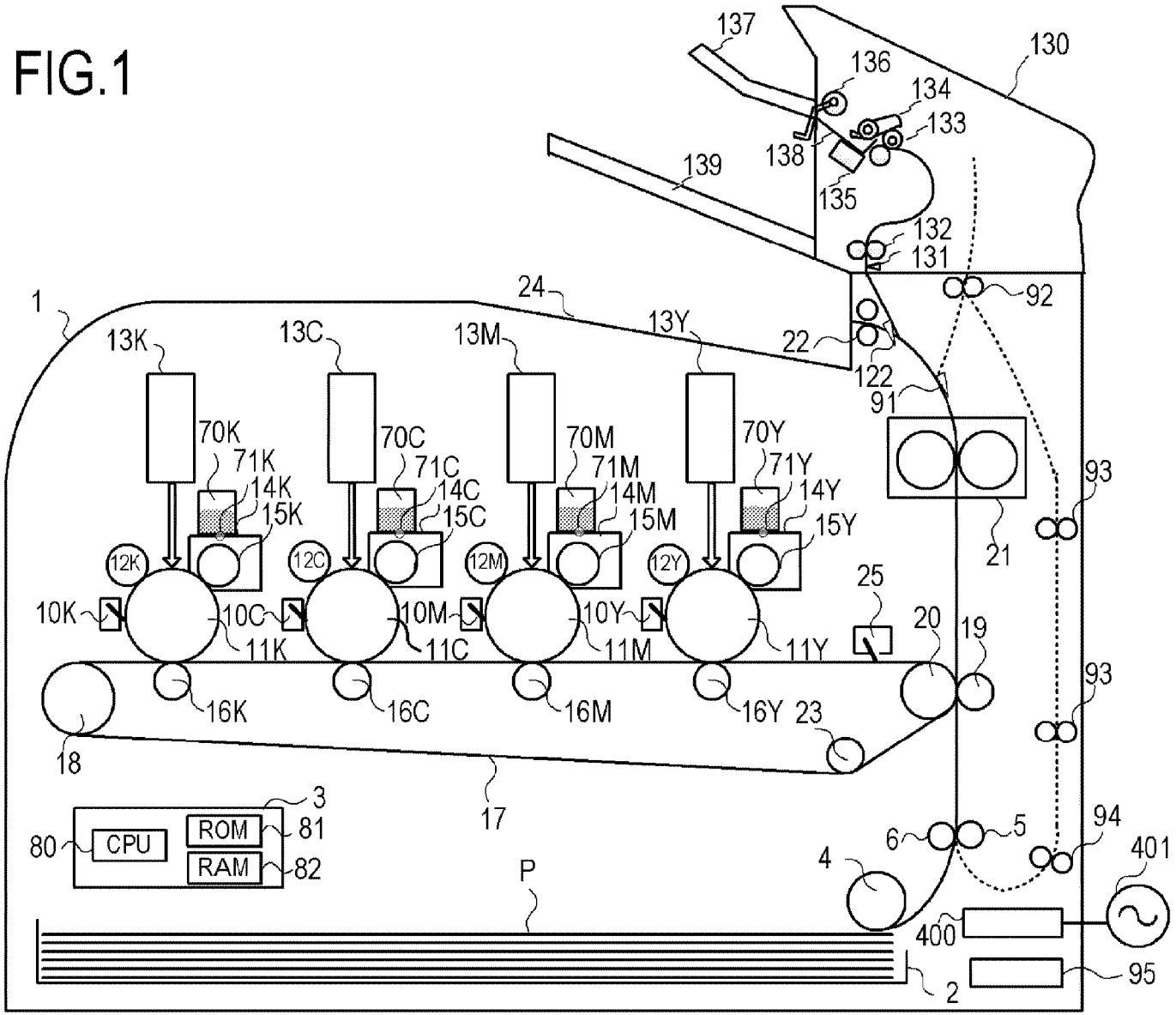
FIG. 1 is a cross-sectional view depicting an image forming apparatus according to Examples 1 and 2.

FIG. 1 is a diagram depicting an electrophotographic type image forming apparatus according to an example of the present invention. The present invention can be applied to such an image forming apparatus as an electrophotographic or electrostatic recording type copier, printer and facsimile, and a case of applying the present invention to a laser printer will be described here.

An image forming apparatus according to Example 1 is an electrophotographic type laser printer 1 (hereafter "printer 1"), and is a tandem type color printer. In other words, a color image can be formed on a recording material P, such as paper, by superimposing four colors of toner (developer): yellow (Y), magenta (M), cyan (C) and black (K). In the following, the subscripts Y, M, C and K attached to the reference sign of a composing element may be omitted unless a distinction among yellow, magenta, can and black is required.

A control portion 3, which controls the operation of the printer 1, includes a CPU 80, ROM 81 and a RAM 82. The functions of the control portion 3 will be described in detail later. A recording material P stored in a cassette 2 is fed from the cassette 2 by a feeding roller 4, and is transported by a transport roller 5 and a transport counter roller 6 which faces the transport roller 5. The printer 1 includes a photosensitive drum 11 (image bearing member) which bears a toner image of each color (developer image) and a charging roller 12 (a charging member) which uniformly charges the photosensitive drum 11 to a predetermined potential. The printer 1 also includes an optical unit 13 (an exposing unit) that irradiates a light, corresponding to the image data of each color, to the charged photosensitive drum 11, and forms an electrostatic latent image. Further, the printer 1 includes a developing unit 14 which makes the electrostatic latent image formed on the photosensitive drum visible, and forms a toner image, and a developer transport roller 15 (a developer carrying member) that transports the toner to the photosensitive drum 11. A toner replenishing screw 71 is operated by driving a replenishing motor (not illustrated), whereby the toner is replenished from a toner cartridge 70 to the developing unit 14. The toner image formed on the photosensitive drum 11 is primarily transferred to an intermediate transfer belt 17 (an intermediate transfer member) using a primary transfer roller 16 (primary transfer member). The toner remaining on the photosensitive drum 11 after the primary transfer is removed by a drum cleaner 10.

A driver roller 18, a tension roller 23 and a secondary transfer counter roller 20, by which the intermediate transfer belt 17 is stretched, are rotary-driven in the counterclockwise direction in FIG. 1. The driver roller 18 rotates receiving the drive force to drive the intermediate transfer belt 17. The tension roller 23 applies tension to the intermediate transfer belt 17. A secondary transfer roller 19 (secondary transfer member) is disposed at a position facing the secondary transfer counter roller 20 via the intermediate transfer belt 17, and secondarily transfers the toner image, which was primarily transferred to the intermediate transfer belt 17, to the transported recording material P. The toner remaining on the intermediate transfer belt 17 after the secondary transfer is removed by a belt cleaner 25. The recording material P, on which the toner image was secondarily transferred, is transported to the fixing apparatus 21 where the toner image is fixed. The recording material P, on which the toner image was fixed by the fixing apparatus 21, is discharged out of the printer 1 by a discharging roller 22, and is placed on a paper delivery tray 24.

A flapper 91, a reversing roller 92 and double-sided printing transport rollers 93 and 94 are used when double-sided printing is executed for the recording material P. An environment sensor 95 detects the ambient environment (temperature, humidity) of the installed printer 1.

An image forming operation by the printer 1 will be described next. First an image forming instruction or image data is inputted from a host computer (not illustrated) to the control portion 3. Then the printer 1 starts the image forming operation, and a recording material P is fed from the cassette 2 by the feeding roller 4. The recording material P is transported by the transport roller 5 and the transport counter roller 6 to the secondary transfer nip portion (not illustrated) formed by the secondary transfer roller 19 and the secondary transfer counter roller 20, so as to match with the timing of a toner image that is formed on the intermediate transfer belt 17.

Along with the operation of feeding the recording material P from the cassette 2, each photosensitive drum 11 is charged to a predetermined potential by the charging roller 12. Then the optical unit 13 forms an electrostatic latent image in accordance with the inputted image data by exposing the charged surface of the photosensitive drum 11 using the laser beam. To make the electrostatic latent image visible, the developing unit 14 and the developer transport roller 15 perform development. The electrostatic latent image formed on the surface of the photosensitive drum 11 is developed by the developing unit 14 using respective colors. Each photosensitive drum 11 contacts the intermediate transfer belt 17, and rotates synchronizing with the rotation of the intermediate transfer belt 17. Each toner image developed with each color is primarily transferred to the intermediate transfer belt 17 sequentially by the primary transfer roller 16. The toner remaining on the photosensitive drum 11, without being primary-transferred to the intermediate transfer belt 17, is cleaned by the drum cleaner 10.

The toner image formed on the intermediate transfer belt 17 by the secondary transfer roller 19 and the secondary transfer counter roller 20 is secondarily transferred to the recording material P. The toner image, secondary-transferred to the recording material P, is fixed to the recording material P by being heated and pressed by the fixing apparatus 21. The toner remaining on the intermediate transfer belt 17, without being secondary-transferred to the recording material P, is cleaned by the belt cleaner 25.

In the above configuration, the configuration related to forming the unfixed toner image on the recording material P corresponds to an image forming portion of the present invention, and the configuration related to fixing (heating) the unfixed toner image to the recording material P corresponds to a fixing portion of the present invention.

In the case of not forming an image on the back surface of the recording material P, the recording material P, on which the image was fixed, is guided by the flapper 91 to a transport path on which the discharging roller 22 is disposed, and is discharged to the paper delivery tray 24. In FIG. 1, the transport path is indicated by the solid line. On the other hand, in the case of forming an image on the back surface of the recording material P as well, the recording material P is guided by the flapper 91 to the transport path on which the reversing roller 92 is disposed. This transport path is indicated by the dotted line in FIG. 1. The reversing roller 92 transports the recording material P in the direction of discharging the recording material P to outside the printer, and rotates in reverse when a predetermined time elapsed after the rear end of the recording material P (edge of the recording material P at the upstream side in the transport direction) passes the flapper 91. Then the reversing roller 92 transports the recording material P to a double-sided printing transport roller 93. Then the double-sided printing transport roller 93 transports the recording material P to a double-sided printing transport roller 94, and pauses in a state of the recording material P being nipped by the double-sided printing transport roller 94. Then the recording material P is transported again to the transport roller 5 and the transport counter roller 6 at a predetermined timing, and an image is formed in the same manner as on the front surface. By the above operation, double-sided printing can be executed on the recording material P.

In the case of performing post-processing on the printed recording material P, a switching flapper 122, which switches between discharging the recording material P to outside the printer and discharging the recording material P to a post-processing apparatus, is selected to the direction of the post-processing apparatus, so that the recording material P is discharged to the post-processing apparatus 130. When a post-processing apparatus entry sensor 131 detects a front end of paper (front end of recording material), the post-processing apparatus 130 transports the recording material P using a post-processing apparatus entry roller 132, and feeds the recording material P to the discharging roller 133. An intermediate loading portion 138, which temporarily stores the recording material P, is disposed at the downstream side of the discharging roller 133, and a jogger 137, which supports both edges of the recording materials in the width direction and aligns the recording materials in a direction orthogonal to the recording material transport direction, is disposed at the downstream side of the intermediate loading portion 138.

A loading portion is constituted by the jogger 137 and the intermediate loading portion 138, hence the recording material is loaded on the jogger 137 and the intermediate loading portion 138. A transport direction aligning paddle 134 is disposed at the upper part of the upstream side of the jogger 137, and the discharging roller 136 is disposed at the downstream side thereof. This discharging roller 136 can switch between nipping and separation.

The intermediate loading portion 138 includes a recording material binding unit 135 (hereafter stapler) which binds the edges of the aligned stack of recording materials. A recording material loading portion 139 is disposed below the jogger 137 in the vertical direction. When the discharging roller 136 is nipped and the jogger 137 is in a retreat position, the transported recording material P is discharged to the recording material loading portion 139 without being temporarily loaded to the intermediate loading portion 138. When the post-processing apparatus 130 performs the stapling processing, the post-processing apparatus 130 receives the recording material by the post-processing apparatus entry roller 132, and feeds the recording material to the discharging roller 133. Then the recording material P is transported by the discharging roller 133 to the intermediate loading portion 138, which temporarily loads the recording material P. At this time, the discharging roller 136 is in the separated state. When the recording material P is transported to the intermediate loading portion 138, the jogger 137 moves to a position to receive the recording material P. Then the recording material P is transported to the intermediate loading portion 138 and the jogger 137 in a state in which both edges in the width direction are supported. The jogger 137 aligns the loaded recording materials P in the direction orthogonal to the transport direction of the recording material P. Then the jogger 137 aligns the loaded recording materials P in the transport direction using the transport direction aligning paddle 134.

When alignment in the transport direction ends, the stapler 135 executes the stapling processing. After the recording materials P are stapled, the stapled recording materials are discharged to the recording material loading portion 139 by nipping the discharging roller 136, whereby the series of processing ends.

The image forming apparatus 1 according to Example 1 is connected to a commercial AC power supply 401 to receive power. A power supply circuit 400 is constituted by a primary side which is directly connected to the AC power supply 401, and a secondary side which is connected to the AC power supply 401 without contact, and is controlled by the control portion 3. According to the image forming apparatus 1, at the primary side of the power supply circuit 400, a heating element of the fixing apparatus 21 is directly connected to the AC power supply 401, and receives power. At the secondary side of the power supply circuit 400, motors and units that operate when an image is formed (e.g. motors to rotate the photosensitive drums 11 and the intermediate transfer belt 17, optical unit) are connected to the AC power supply 401 without contact, and receive power. The above mentioned stapling motor 140 of the post-processing apparatus 130 and an actuator of a replenishing motor to drive the toner replenishing screw 71 also receive power from the AC power supply 401 at the secondary side of the power supply circuit 400. In the configuration Example 1, the configuration related to control of supplying power to the heating element of the fixing apparatus 21 corresponds to the power control portion of the present invention.

Configuration of Fixing Apparatus

Figure 2:
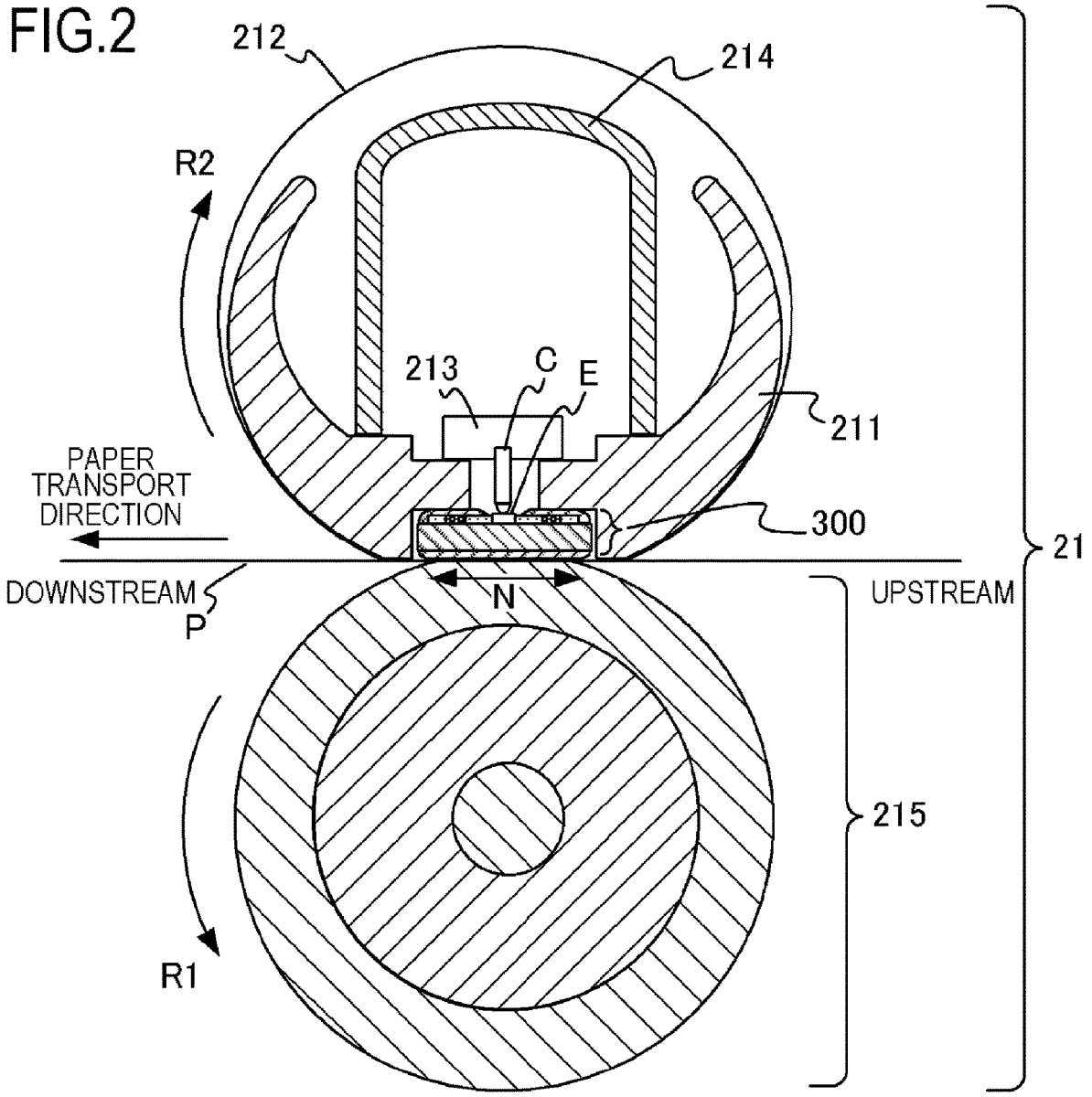
FIG. 2 is a schematic cross-sectional view depicting a fixing apparatus according to Examples 1 and 2.

FIG. 2 is a cross-sectional view of the fixing apparatus 21 of Example 1. The fixing apparatus 21 includes: a fixing film 212 (endless belt); a heater 300 which contacts the inner surface of the fixing film 212; a pressure roller 215 which forms the fixing nip portion N with the heater 300 via the fixing film 212; and a metal stay 214. The fixing film 212, the heater 300 and various composing elements disposed on the inner side of the fixing film 212 correspond to the heating member according to the present invention, and the pressure roller 215 corresponds to the pressure member.

The heater 300 is held in a heater holding member 211 made of heat-resistant resin, and heats the heating region disposed in the fixing nip portion N, whereby the fixing film 212 is heated. The heater holding member 211 also has a guide function to guide rotation of the tubular fixing film 212. The heater 300 includes an electrode E which is disposed on the opposite side of the fixing nip portion N, and supplies power to the electrode E via an electric contact C. The metal stay 214 receives a pressing force (not illustrated), and energizes the heater holding member 211 toward the pressure roller 215. Furthermore, a safety element 213, such as a thermo-switch and temperature fuse, which is activated by an abnormal heating of the heater 300 and stops power supplied to the heater 300, is disposed so as to directly contact the heater 300 or to indirectly contact the heater 300 via the heater holding member 211.

The pressure roller 215 receives power from the motor (not illustrated) and rotates in the arrow mark R1 direction. By the rotation of the pressure roller 215, the fixing film 212 follows and rotates in the arrow mark R2 direction. The fixing nip portion N holds and transports the recording material P while the heat of the fixing film 212 is transferred to the recording material P, whereby the unfixed toner image on the recording material P is fixed.

Figure 3A:
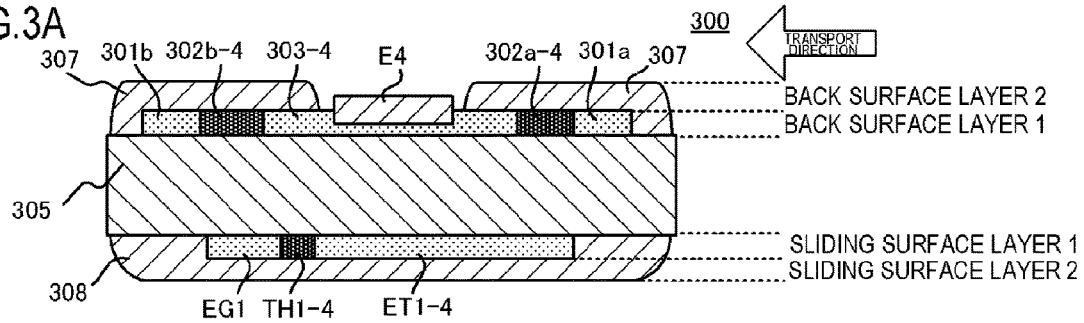
FIG. 3A to FIG. 3C indicate schematic cross-sectional views depicting a heater according to Examples 1 and 2.

A configuration of the heater 300 according to Example 1 will be described with reference to FIG. 3A to FIG. 3C. FIG. 3A is a cross-sectional view of the heater 300, FIG. 3B is a plan view of each layer of the heater 300, and FIG. 3C is a diagram depicting a method of connecting the electric contact C to the heater 300.

Figure 3B:
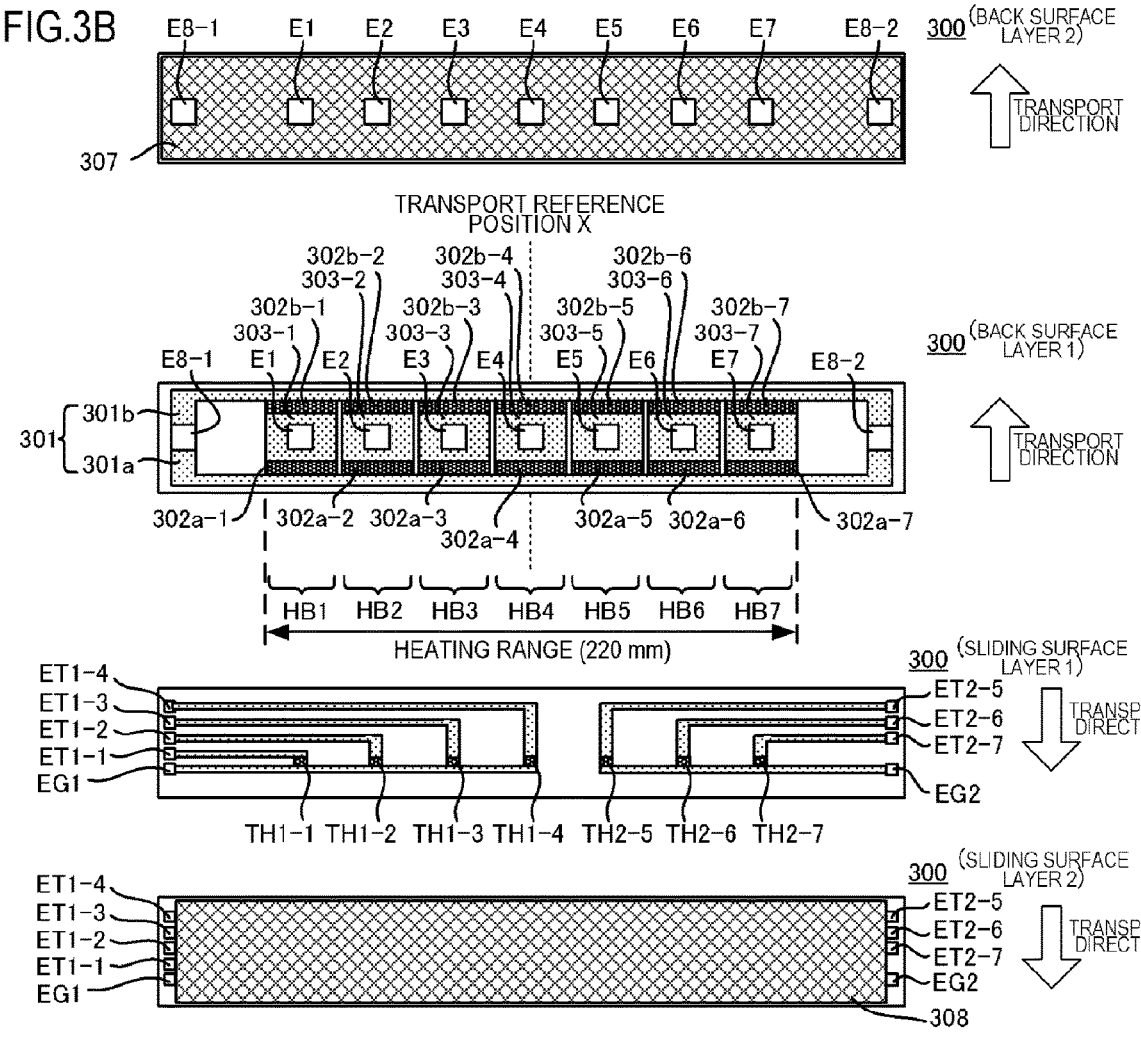
Figure 3C:
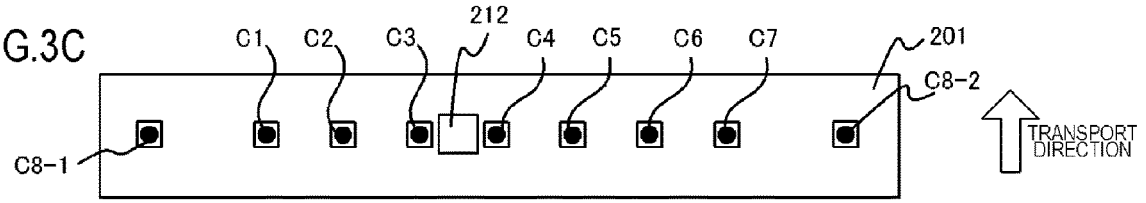

In FIG. 3B, a transport reference position X, to transport the recording material P in the printer 1 of Example 1 is indicated. The transport reference in Example 1 is at the center, and the recording material P is transported such that the center line, orthogonal to the transport direction, is located along the transport reference position X. FIG. 3A is a cross-sectional view of the heater 300 at the transport reference position X.

The heater 300 is constituted by a ceramic substrate 305, a back surface layer 1 disposed on the substrate 305, a back surface layer 2 which covers the back surface layer 1, a sliding surface layer 1 disposed on the surface of the substrate 305 on the opposite side of the back surface layer 1, and a sliding surface layer 2 which covers the sliding surface layer 1.

The back surface layer 1 includes conductors 301 (301*a*, 301*b*) which are disposed along the heater 300 in the longer direction. The conductor 301 is divided into the conductor 301*a* and the conductor 301*b*, and the conductor 301*b* is disposed at the downstream side of the conductor 301*a* in the transport direction of the recording material P. The back surface layer 1 also includes conductors 303 (303-1 to 303-7) which are disposed in parallel with the conductors 301*a* and 301*b*. The conductors 303 are disposed between the conductor 301*a* and the conductor 301*b* along the longer direction of the heater 300.

Further, the back surface layer 1 includes heating elements 302*a* (302*a*-1 to 302*a*-7) and the heating elements 302*b* (302*b*-1 to 302*b*-7), which are heating resistors that generate heat when power is supplied. The heating element 302*a* is disposed between the conductor 301*a* and the conductor 303, and generates heat by power which is supplied via the conductor 301*a* and the conductors 303. The heating element 302*b* is disposed between the conductor 301*b* and the conductors 303, and generates heat by power which is supplied via the conductor 301*b* and the conductors 303.

A heating area, which is constituted by the conductors 301, the conductors 303, the heating element 302*a* and the heating element 302*b*, is divided into seven heating blocks (HB1 to HB7) in the longer direction of the heater 300. In other words, the heating element 302*a* is divided into seven regions (heating elements 302*a*-1 to 302*a*-7) in the longer direction of the heater 300. The heating element 302*b* is divided into seven regions (heating elements 302*b*-1 to 302*b*-7) in the longer direction of the heater 300. Further, the conductors 303 are divided into seven regions (conductors 303-1 to 303-7) corresponding to the divided positions of the heating elements 302*a* and 302*b*. The heating value of each of the seven heating blocks (HB1 to HB7) is independently controlled by independently controlling the power that is supplied to the heating resistor in each block. Thereby the heating regions A(1) to A(7), which are determined by dividing the fixing nip portion N into a plurality of regions in the longer direction, can be independently heated.

The back surface layer 1 also includes the electrodes E (E1 to E7, E8-1 and E8-2). The electrodes E1 to E7 are disposed in the regions of the conductors 303-1 to 303-7 respectively, and supplies power to the heating blocks HB1 to HB7 via the conductors 303-1 to 303-7 respectively. The electrodes E8-1 and E8-2 are disposed so as to connect the conductors 301 to the ends of the heater 300 in the longer direction, and are used to supply power to the heating blocks HB1 to HB7 via the conductors 301.

The back surface layer 2 is formed of a surface protective layer 307 having an insulating property (glass in Example 1), and covers the conductors 301, the conductors 303 and the heating elements 302*a* and 302*b*. The surface protective layer 307 is formed excluding the areas of the electrodes E, so that the electric contacts C can be connected to the electrodes E from the side of the back surface layer 2 of the heater.

The sliding surface layer 1, which is disposed on the substrate 305 on the opposite side of the back surface layer 1, includes the thermistors TH (TH1-1 to TH1-4 and TH2-5 to TH2-7) to detect the temperature of each heating block HB1 to HB7.

The sliding surface layer 2 is formed of a surface protective layer 308 having a sliding property and an insulating property (glass in the case of Example 1), and covers the thermistors TH, the conductors ET and the conductors EG, while ensuring slidability with the inner surface of the fixing film 212. The surface protective layer 308 is formed excluding both ends of the heater 300 in the longer direction, so that the electric contacts are disposed for the conductors ET and the conductors EG.

A method of connecting each electric contact C to each electrode E will be described next. FIG. 3C is a plan view depicting the state of connecting each electric contact C to each electrode E viewed from the side of the heater holding member 211. In the heater holding member 211, a through hole is formed at each position corresponding to each electrode E (E1 to E7, E8-1 to E8-2). At each through hold position, each electric contact C (C1 to C7, C8-1 to C8-2) is electrically connected to each electrode E (E1 to E7, E8-1 to E8-2) respectively, by such a method as an energizing spring or welding.

Configuration of Heating Region

Figure 4:
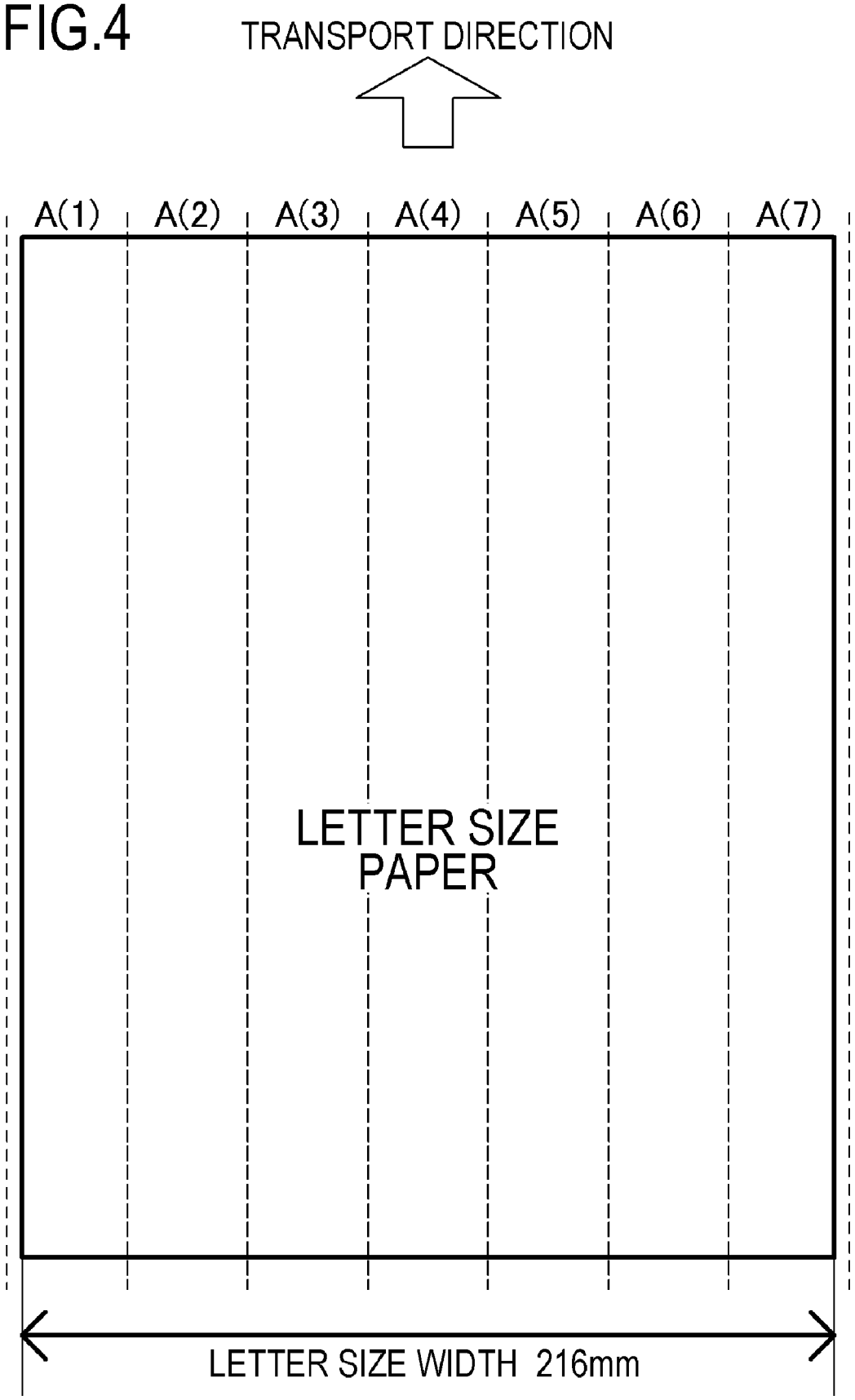
FIG. 4 is a diagram depicting a heating region according to Examples 1 and 2.

FIG. 4 is a diagram depicting seven heating regions A(i) (i=1 to 7), which are separated in the longer direction, according to Example 1, and is depicted in comparison with the size of letter size paper. The heating regions A(i) correspond to the heating blocks HB1 to HB7, so that, for example, the heating region A(1) is heated by the heating block HB1 and the heating region A(7) is heated by the heating block HB7. The heating value of each of the seven heating blocks HB1 to HB7 can be independently controlled since power that is supplied to the heating resistor of each block is independently controlled. The total length of the heating regions A(i) is 220 mm, and each heating region is determined by equally dividing this length by seven.

Figure 5:
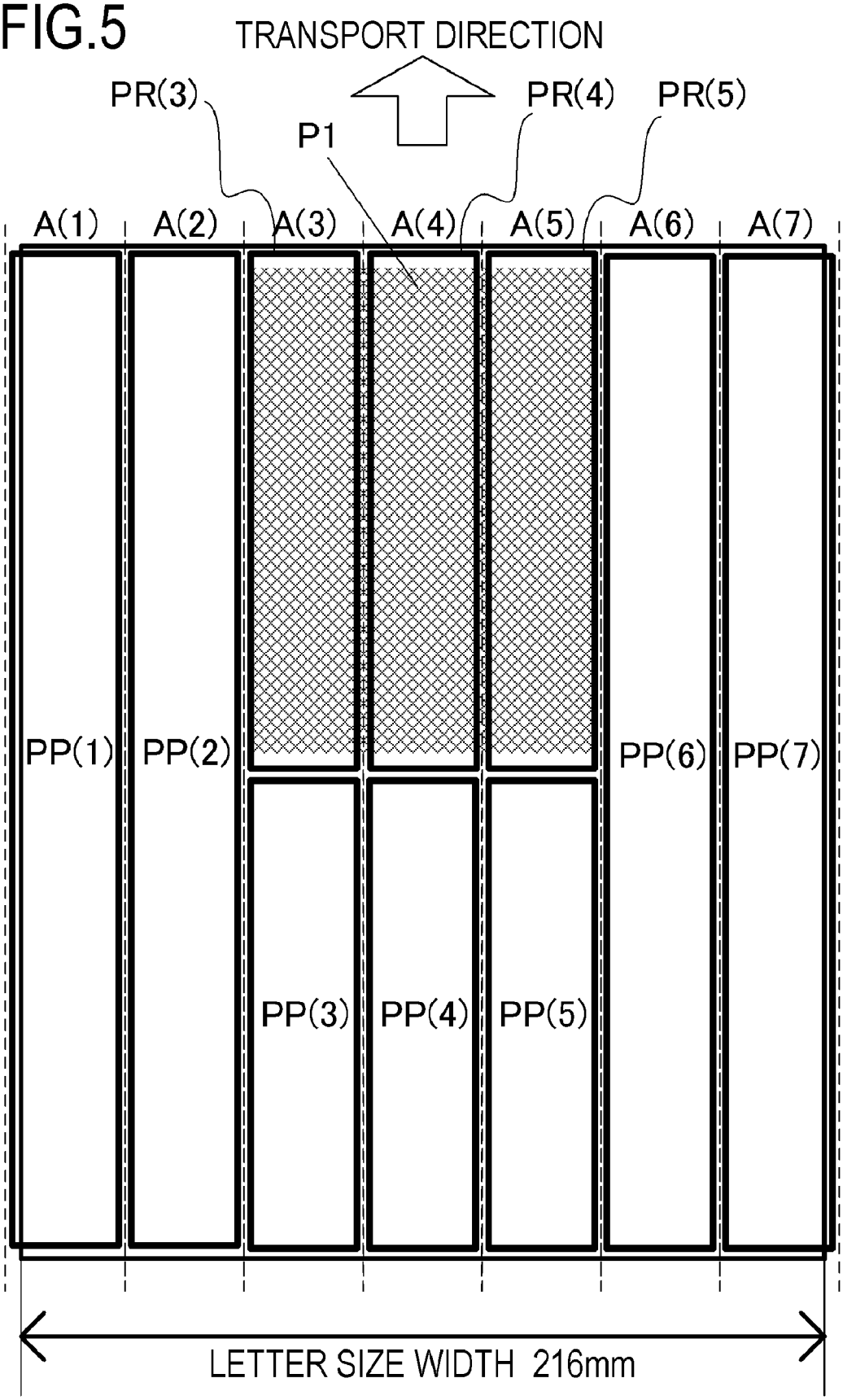
FIG. 5 is a diagram depicting the image and image heating region according to Examples 1 and 2.

FIG. 5 is a diagram depicting an image P1 (shaded portion) formed on the recording material P and the image heating portions PR(i) (i=1 to 7) with respect to the image P1 according to Example 1. The image heating portions PR(i) are blocks where a portion on which image data is formed is heated in each heating region, and are indicated by a bold frame superimposed on the image P1 in FIG. 5. In the heating regions, the blocks excluding the image heating portions PR(i) are non-image heating portions PP(i) (i=1 to 7), and are indicated by a bold frame. In other words, the heating regions A(i) are constituted of the image heating regions PR(i) and the non-image heating regions PP(i).

In Example 1, the image P1 is formed in a part of the heating regions A(3) to A(5). Therefore in each of the heating regions A(3) to A(5), the image heating portion PR and the non-image heating portion PP exist. In the heating regions A(1), A(2) and A(6) and A(7), an image is not formed in an entire region, that is, here the entire region is the non-image heating portion PP(i), and the image heating portion PR(i) does not exist.

Hardware Configuration of Image Forming Apparatus

Figure 20:
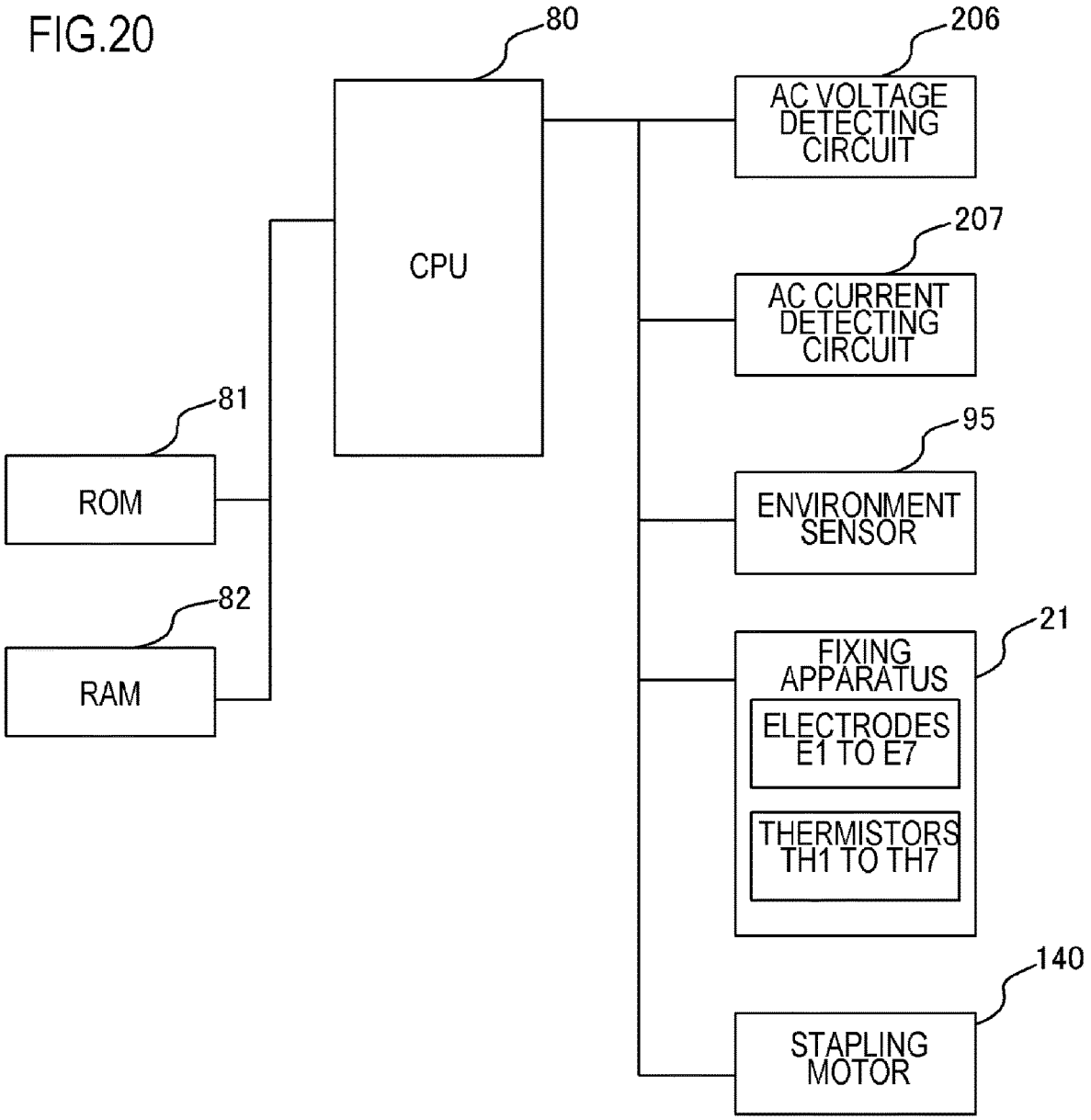
FIG. 20 is a hardware block diagram according to Example 1.

FIG. 20 is a hardware block diagram according to Example 1. The hardware configuration according to Example 1 includes: the CPU 80; an AC voltage detecting circuit 206; an AC current detecting circuit 207; an environment sensor 95; the fixing apparatus 21 including the electrodes E1 to E7 and the thermistors TH1 to TH7; and the stapling motor 140. The CPU 80 includes the ROM 81 and the RAM 82. The AC voltage detecting circuit 206 outputs a voltage value corresponding to an effective voltage of the AC power supply 401, and the CPU 80 receives the voltage value via an analog input port and detects a value of the effective voltage that is inputted by the AC power supply 401. The AC current detecting circuit 207 outputs a voltage value corresponding to an effective value of the AC current, and the CPU 80 receives the voltage value via the analog input port, and detects a total current value consumed by the power supply load and the fixing apparatus 21 (fixing unit). The CPU 80 also receives voltage values from the environment sensor 95 and the thermistors TH1 to TH7 of the fixing apparatus 21 corresponding to the respective temperature. The CPU 80 also outputs a signal to each electrode E1 to E7 respectively when power is supplied to the fixing apparatus 21. Further, when the stapler 135 performs stapling processing, the CPU 80 outputs a signal to the motor drive circuit to drive the stapling motor 140.

Configuration of Control Portion of Image Forming Apparatus

Figure 6:
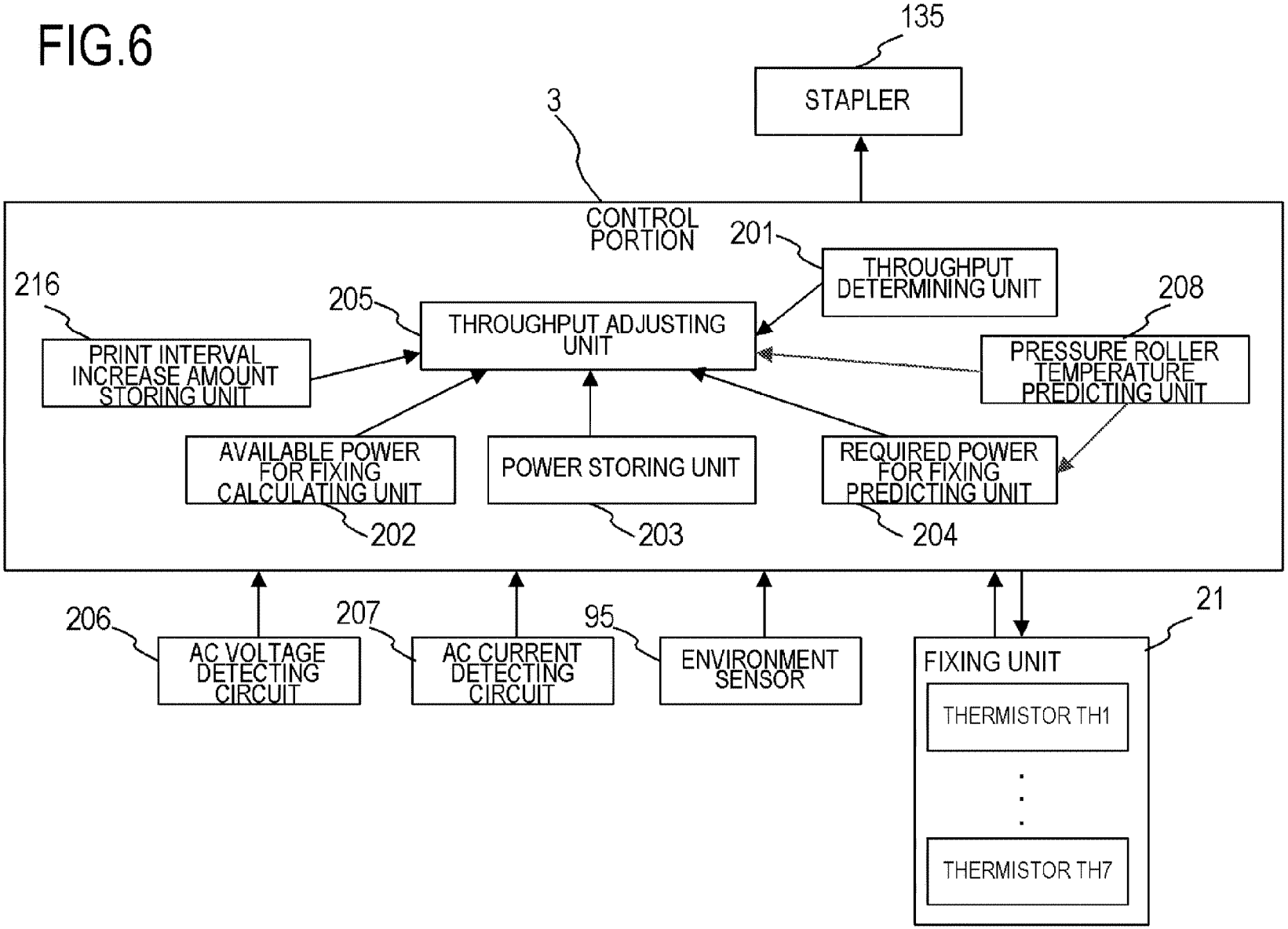
FIG. 6 is a functional block diagram of a control portion according to Example 1.

FIG. 6 is a control block diagram of the image forming system according to Example 1. The control portion 3 includes the CPU 80, the ROM 81 and the RAM 82, and implements operations based on the programs which are stored in the ROM 81 in advance. As illustrated in FIG. 6, the control unit 3 includes a throughput determining unit 201, an available power for fixing calculating unit 202, a power storing unit 203, a required power for fixing predicting unit 204, a throughput adjusting unit 205, a pressure roller temperature predicting unit 208, and a print interval increase amount storing unit 216. The stapler 135, the AC voltage detecting circuit 206, the AC current detecting circuit 207, the environment sensor 95 and the thermistors TH1 to TH7 of the fixing apparatus 21 are also connected to the control portion 3.

Calculation of Available Power for Fixing

The available power for fixing calculating unit 202 calculates the power Plimit that can be supplied to the fixing apparatus using the following Expression 1. Plimit in Example 1 is assumed to be 1000 W.

$$Plimit = Ilimit * Vin * Kpf - Ppsu \quad \text{(Expression 1)}$$

Here Vin is an input voltage value detected by the AC voltage detecting circuit 206, and Kpf is a power factor that is assumed in the entire apparatus. The power factor in Example 1 is a fixed value: 90(%). This is roughly determined by the drive current waveform of the power supply and the heater electrification current waveform in the phase control performed by the heater drive circuit, and is a worst case value that is determined during designing.

Ilimit is an effective current value that must be limited for the supply source, and, for example, 12 Arms is stored in the ROM 81 as an initial set value for a product in the 100 V to 127 V zone, and 6 Arms for a product in the 220 V to 240 V zone. Further, a user may set Ilimit, so as to support a user using a 20 A breaker or a user who must limit current to be very low in response to a specific condition.

Ppsu is power with which load is constantly applied during printing, and is calculated by the following Expression 2, for example.

$$Ppsu = Pe + Pfeed + Pis \quad \text{(Expression 2)}$$

Here Pe is a load power of the image forming apparatus described in FIG. 1, excluding the fixing apparatus 21, and is power that is determined based on the results detected by the AC current detecting circuit 207 and the AC voltage detecting circuit 206.

Pfeed is power of a paper feeding option unit (not illustrated in FIG. 1), and Pis is power of an image scanner (not illustrated). The power values required for these units are determined by considering the power that each unit requires, and are values stored in the ROM 81 in advance as fixed values.

Prediction of Required Power for Fixing

The required power for fixing predicting unit 204 will be described using two examples.

Prediction of Required Power for Fixing—First Example

A first example of the required power for fixing predicting unit 204 will be described with reference to FIG. 7. The lower part of FIG. 7 indicates a prediction of power that is supplied to the fixing apparatus 21 from the entry of the recording material P1 to the fixing apparatus 21 to the exit of the recording material P2 from the fixing apparatus 21 (fixing nip portion N). The ordinate indicates the power that is supplied to the fixing apparatus 21, and the abscissa indicates the elapsed time from the entry of the recording material P1 to the fixing apparatus 21. The upper part of FIG. 7 indicates the paper position, image position and print percentage of the recording materials P1 and P2. The timing at (1) in FIG. 7 indicates a timing at which the rear end of the image on the recording material P1 exits the fixing nip portion N, and at this timing, the control is switched to the control for the next recording material P2. As indicated in Table 1, the average print percentage of the recording material P1 is 200% in all the heating regions A(i), but the average print percentage of the recording material P2 is 0% in A(1) and A(7), since there is no image in A(1) and A(7). The average print percentage is a total value of the density % of each color, and in the case of an image in a region where magenta is 100% and cyan is 100%, for example, the average print percentage is 200%. If an image exits in half of this region, for example, the average print percentage is 100%. The power values in each case are indicated in Table 1, and power is consumed even if the average print percentage is 0%. This is because A(1) and A(7) can be supported, so that the outer edges of A(2) and A(6) are fixed with certainty, even if the recording material deviates in a direction orthogonal to the transport direction.

Figure 7:
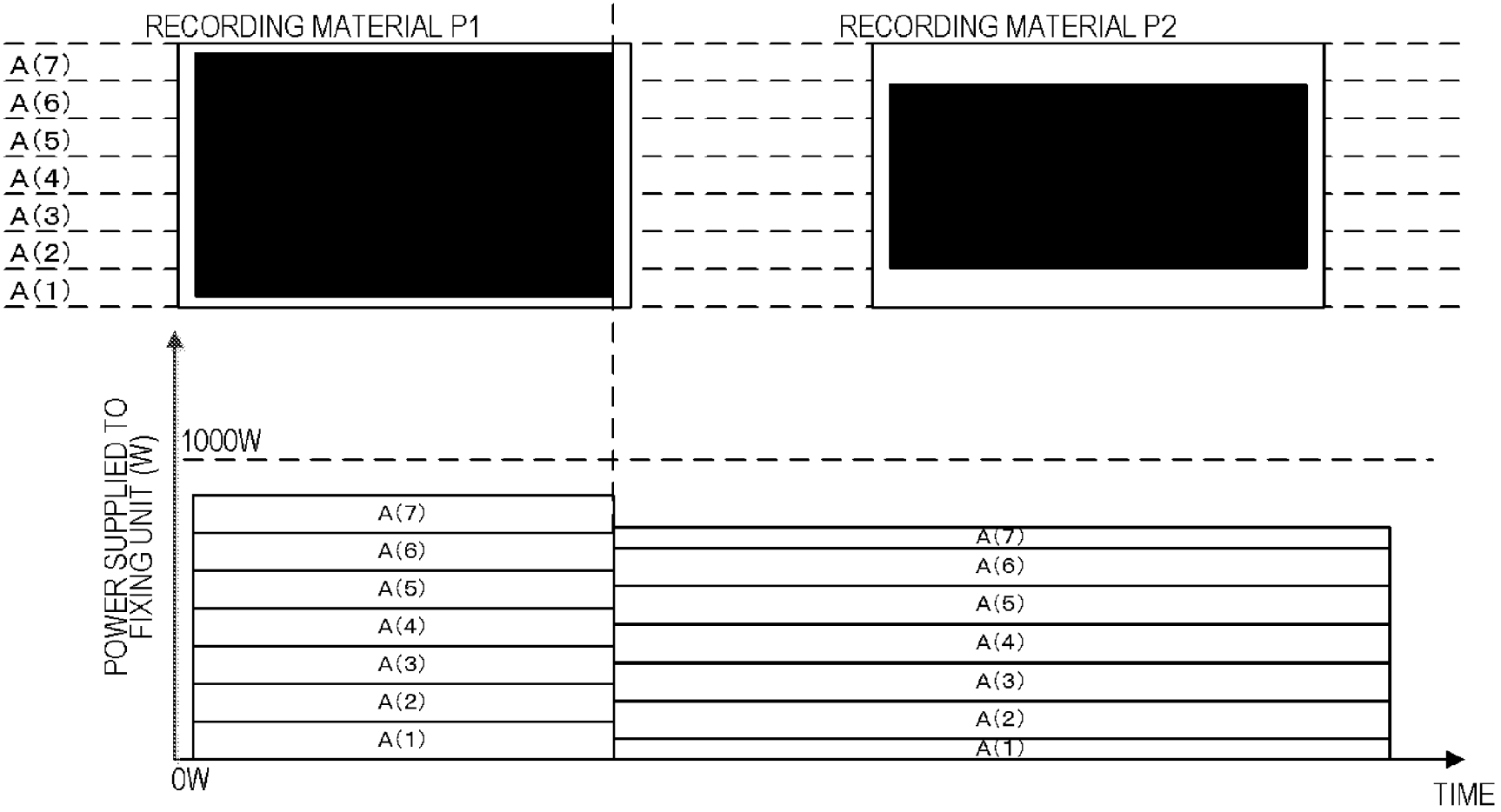
FIG. 7 is a diagram depicting a power prediction example 1 according to Example 1.
Figure 8:
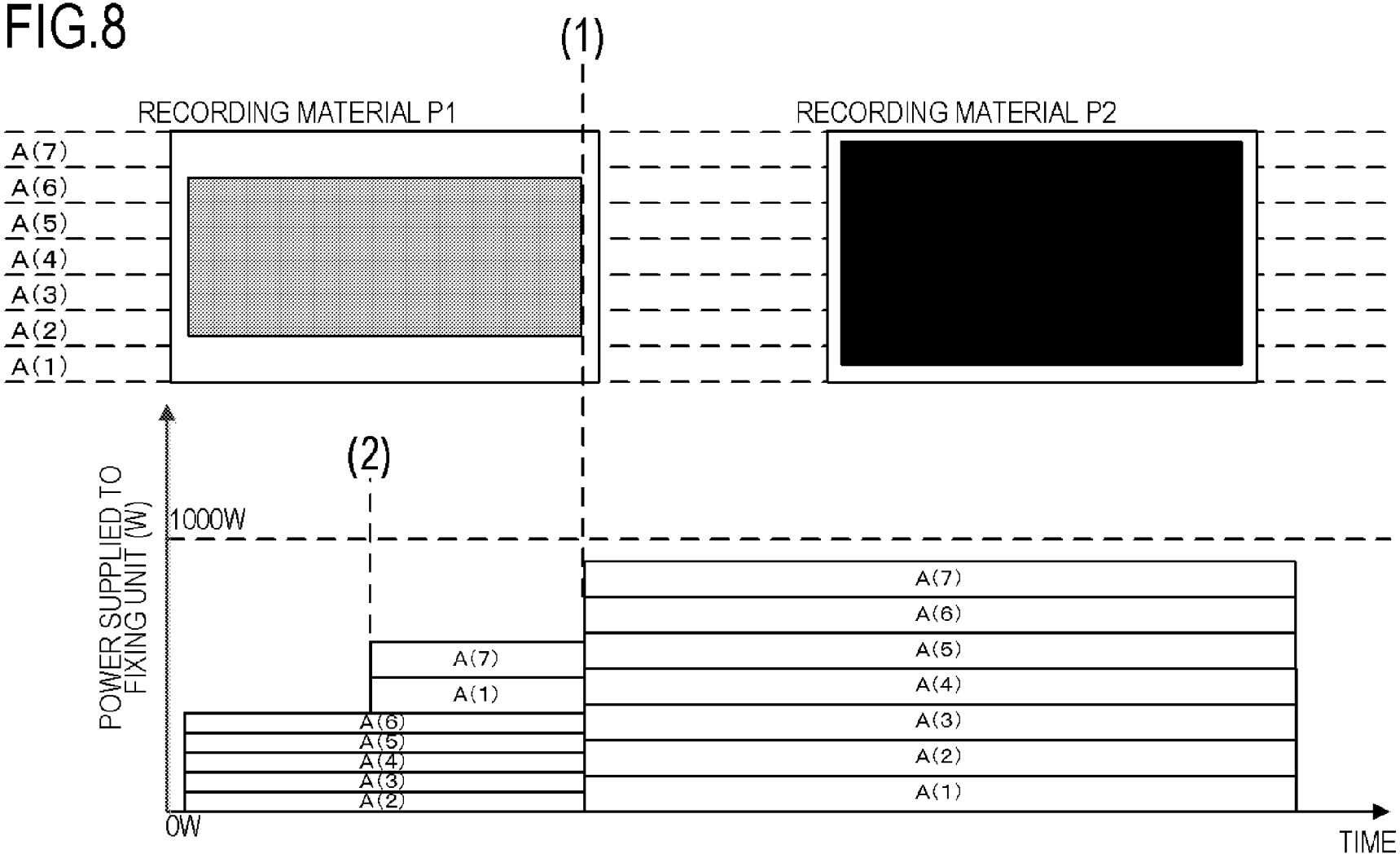
FIG. 8 is a diagram depicting a power prediction example 2 according to Example 1.

The timing at which power is started to be supplied to fix the image in each A(i) of the recording material P1, indicated in the lower part of FIG. 7 and FIG. 8, is before the timing when the image on the recording material P1 enters the fixing apparatus 21. In other words, just like the timing in (1) for the recording material P2, the power is supplied at an early timing so that the fixing nip portion N reaches a predetermined control target temperature with certainty, at a timing when the image on the recording material P1 enters the fixing nip portion N. This is the same for the following FIG. 9 to FIG. 11 and FIG. 14 to FIG. 18.

TABLE 1

| | Recording material P1 | | Recording material P2 | |
|---|---|---|---|---|
| | Average print percentage | Power | Average print percentage | Power |
| A(7) | 200% | 140 W | 0% | 80 W |
| A(6) | 200% | 140 W | 200% | 140 W |
| A(5) | 200% | 140 W | 200% | 140 W |
| A(4) | 200% | 140 W | 200% | 140 W |
| A(3) | 200% | 140 W | 200% | 140 W |
| A(2) | 200% | 140 W | 200% | 140 W |
| A(1) | 200% | 140 W | 0% | 80 W |

The data in Table 1 indicates data in a specific warmup state of the pressure roller 215 under a specific environment, and is preferably corrected by the scale factors indicated in Table 2.

TABLE 2

| | Environment temperature | | | |
|---|---|---|---|---|
| | ~10° C. | 11~17° C. | 18~25° C. | 26° C.~ |
| Warmup level D1 | 1.2 | 1.1 | 1.0 | 0.9 |
| Warmup level D2 | 1.1 | 1.0 | 0.9 | 0.8 |
| Warmup level D3 | 1.0 | 0.9 | 0.8 | 0.7 |
| Warmup level D4 | 0.9 | 0.8 | 0.8 | 0.7 |

The environment temperature in Table 2 indicates the results acquired by the environment sensor 95, and indicates correction values considering that higher power is needed as the ambient temperature lowers.

The warmup level Dx(i) and the predicated temperature D(i), which will be described later, are an index and a temperature corresponding to the heating regions A(i).

The warmup level Dx(i) in Table 2 is an index that indicates the warmup state of the pressure roller 215. The warmup level Dx(i) indicates correction values considering that the pressure roller 215 is in a lower warmup state, and more power is needed as the warmup level is lower (as the value is smaller).

The warmup level Dx(i) is determined by a following pressure roller temperature predicting unit 208, for example. The warmup level Dx(i) is calculated based on the predicted temperature D(i) of the pressure roller 215 and the temperature of the thermistor when printing started. First the predicted temperature D(i) of the pressure roller 215 is calculated using the following Expression 3.

$$D(i)=D0(i)+\text{previous number of rotations}\times\Delta m-\text{number of prints continuously printed}\times\Delta tp-\text{print stop time}\times\Delta tw \quad \text{(Expression 3)}$$

Here D0(*i*) is an initial temperature of the pressure roller 215, and is approximately a room temperature if printing starts in a cooled state, and if printing starts in a warm state, a pressure roller predicted temperature D, which is calculated at this point, is used for D0(*i*). Further, μm is a rising temperature of the pressure roller 215 per forward rotation, Δtp is a temperature transferred to the recording material P each time the pressure roller 215 prints, and Δtw is a cooling temperature per unit time when printing stops. Using this expression, the control portion 3 calculates the predicted temperature of the pressure roller 215. The pressure roller rising temperature Δm per forward rotation, the temperature Δtp transferred to the recording material P at each print operation, and the cooling temperature per unit time when printing stops need not be fixed values. These values may be variable depending on the environment temperature, thermistor temperature, warmup state, number of prints continuously fed and the like in the case when more precision is required.

Then the control portion 3 detects the thermistor temperature TH(i) inside the fixing apparatus 21. The warmup level Dx(i) of the fixing apparatus 21 is determined based on the pressure roller predicted temperature D(i) and the thermistor temperature TH(i) using Table 3.

TABLE 3

(Unit: level)

| | | Thermistor temperature TH(i) | | |
|---|---|---|---|---|
| | | ~100° C. | 101~130° C. | 131° C. |
| Pressure roller predicted temperature D(i) | ~100° C. | 1 | 2 | 3 |
| | 101~130° C. | 2 | 3 | 4 |
| | 131° C.~ | 3 | 4 | 4 |

In other words, if the print percentage is 200%, the environment temperature is 15° C., the thermistor temperature TH(1) is 125° C., and the pressure roller predicted temperature (1) is 125° C., then the warmup level is 3 according to Table 3, and the correction scale factor is 0.9 according to Table 2. Therefore the power of A(1) is 140 W×0.9=126 W, for example.

Table 1, Table 2 and Table 3 are design values acquired by considering the performance variation of the fixing apparatus 21. A table is created using these values stored in the ROM 81 of the control portion 3 in advance. In Example 1, power is estimated from the print percentage information for each print, but power may be estimated based on the average of the print percentages of a plurality of recording materials or the highest print percentage among the recording materials.

Prediction of Required Power for Fixing—Second Example

A second example of the required power for fixing predicting unit 204 will be described with reference to FIG. 8. The lower part of FIG. 8 indicates a prediction of power that is supplied to the fixing apparatus 21 from the entry of the recording material P1 to the fixing apparatus 21 to the exit of the recording material P2 from the fixing apparatus 21 (fixing nip portion N). The ordinate indicates the power that is supplied to the fixing apparatus 21, and the abscissa indicates the elapsed time from the entry of the recording material P1 to the fixing apparatus 21. The upper part of FIG. 8 indicates the paper position, image position and print percentage of the recording materials P1 and P2 in this case. The timing at (1) in FIG. 8 indicates a timing at which the rear end of the image on the recording material P1 exits the fixing nip portion N, and at this timing, the control is switched to the control for the next recording material P2. The timing at (2) in FIG. 8 indicates a timing at which power starts to be supplied in order to increase temperature for the images of A(1) and A(7) of the recording material P2 while heating the recording material P1. As indicated in Table 4, in the recording material P1, the average print percentage is 100% in A(2) to A(6), and 0% in A(1) and A(7), and the average print percentage of the recording material P2 is 200% in all the heating regions A(i). The power values in each case are indicated in Table 4, and the power is switched at the timing of (1) and the timing of (2) in FIG. 8.

In the second example as well, the data in Table 4 indicates data in a specific warmup state of the pressure roller 215 at a specific environment temperature, and is preferably corrected by the scale factors indicated in Table 2 of the first example.

TABLE 4

| | Recording material P1 (Up to (2)) | | Recording material P1 (After (2)) | | Recording material P2 | |
|---|---|---|---|---|---|---|
| | Average print percentage | Power | Average print percentage | Power | Average print percentage | Power |
| A7 | 0% | 0 W | 0% | 140 W | 200% | 140 W |
| A6 | 100% | 90 W | 100% | 90 W | 200% | 140 W |
| A5 | 100% | 90 W | 100% | 90 W | 200% | 140 W |
| A4 | 100% | 90 W | 100% | 80 W | 200% | 140 W |
| A3 | 100% | 90 W | 100% | 80 W | 200% | 140 W |
| A2 | 100% | 90 W | 100% | 80 W | 200% | 140 W |
| A1 | 0% | 0 W | 0% | 140 W | 200% | 140 W |

Prediction of Power when Stapler is Operated

The prediction of power including the stapling operation will be described with reference to FIG. 9 and FIG. 10. The lower part of FIG. 9 and FIG. 10 indicates a prediction of power that is supplied to the fixing apparatus 21 and power required for stapling, from the entry of the recording material P1 to the fixing apparatus 21 to the exit of the recording material P2 from the fixing apparatus 21 (fixing nip portion N). The ordinate indicates the total power of the power that is supplied to the fixing apparatus 21 and the power required for stapling, and the abscissa indicates the elapsed time from the entry of the recording material P1 to the fixing apparatus 21. The upper part of FIG. 9 and FIG. 10 indicates the paper position, image position and print percentage of the recording materials P1 and P2 in this case.

Figure 9:
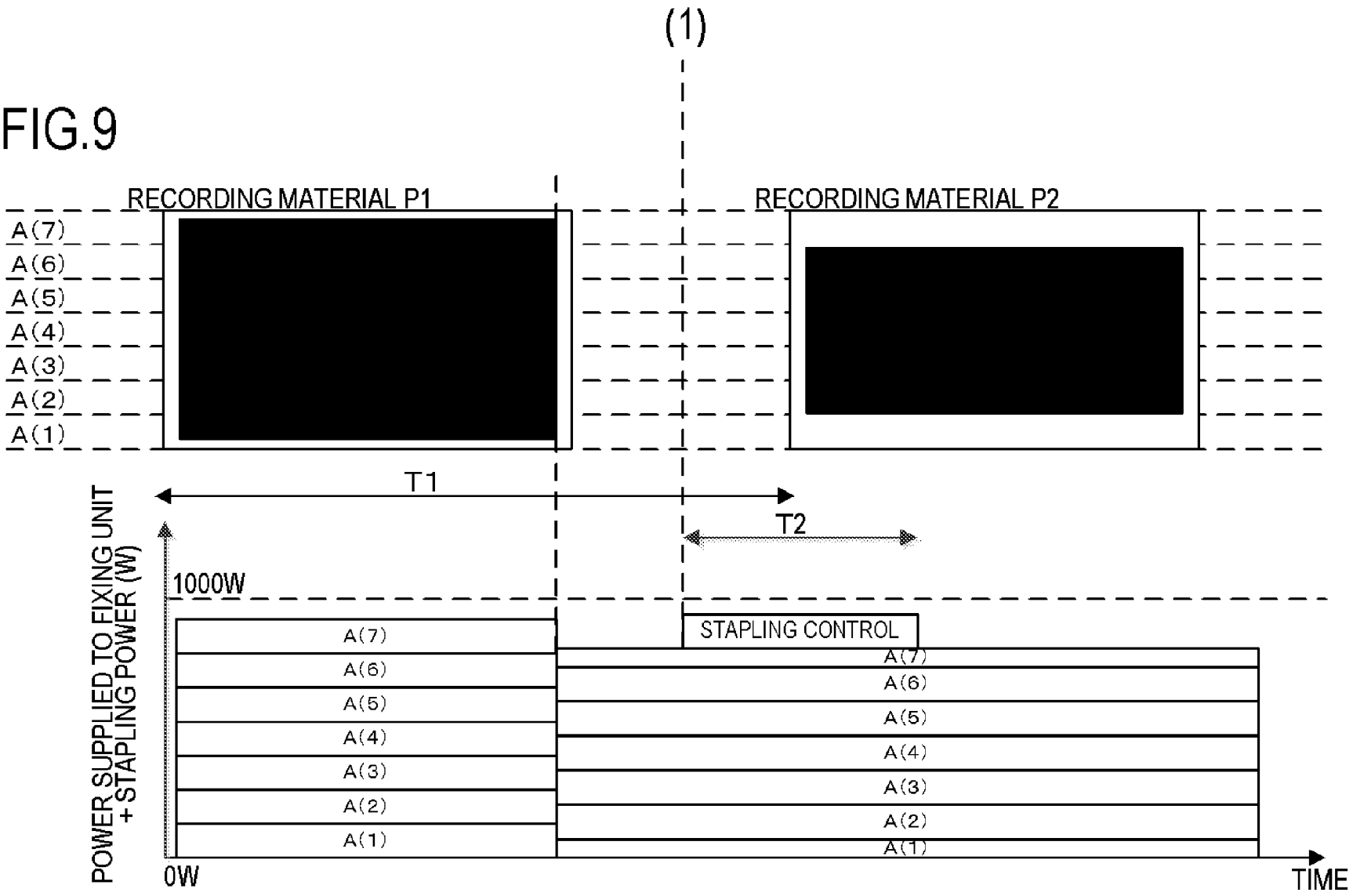
FIG. 9 is a diagram depicting a stapling timing example 1 according to Example 1.
Figure 10:
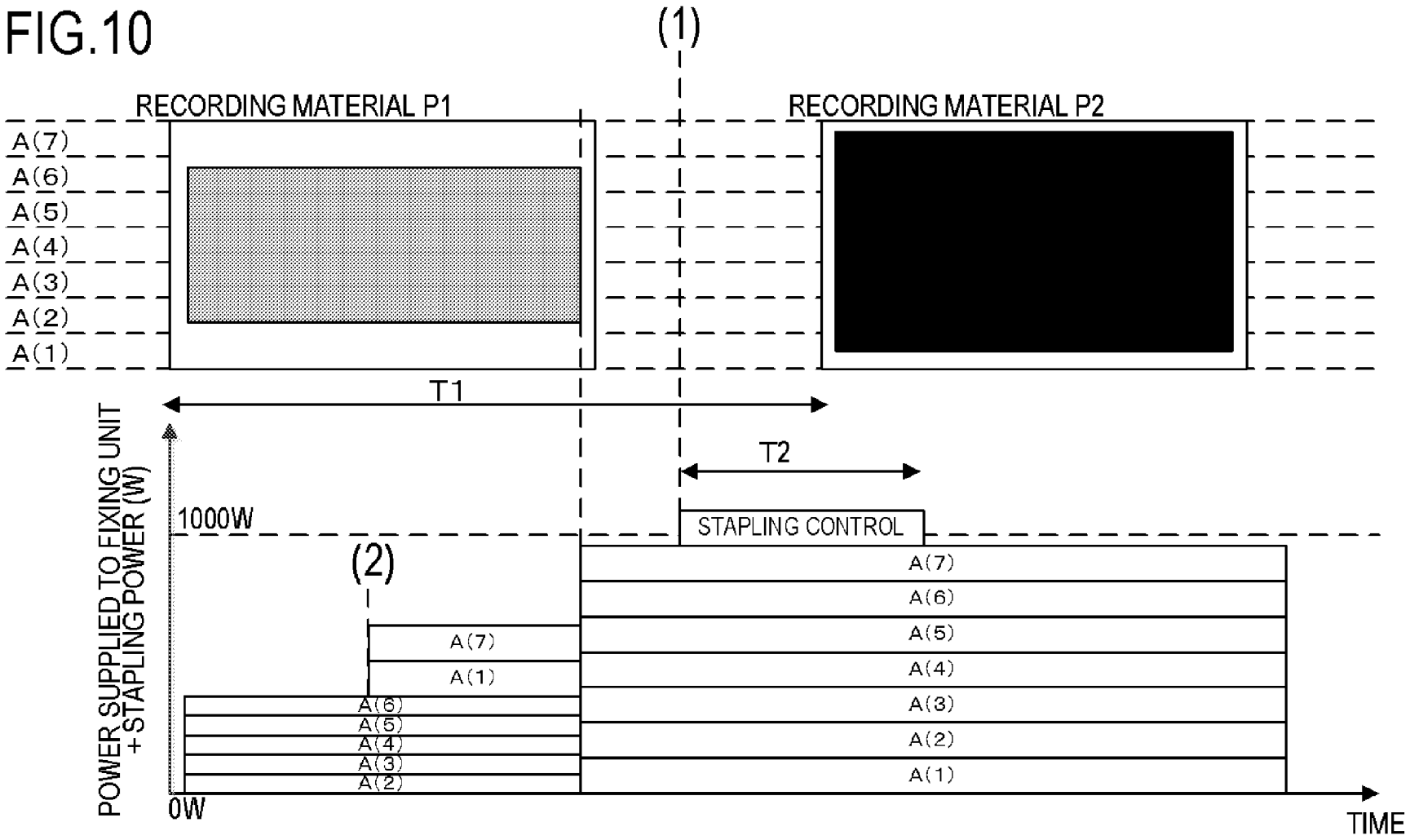
FIG. 10 is a diagram depicting a stapling timing example 2 according to Example 1.

As indicated in FIG. 9 and FIG. 10, T1 is a value determined by a throughput determining unit 201 (interval determining unit), and is determined from the paper size and environment temperature, for example, as indicated in Table 5. T1 is an interval of the recording materials P which are transported to the fixing apparatus 21. For information to determine the throughput (printing productivity which is a number of prints per unit time), the basis weight of the recording material and the environment humidity may be used. Information in Table 1 is merely an example.

TABLE 5

| | Environment temperature | | |
|---|---|---|---|
| | ~10° C. | 11~17° C. | 18° C.~ |
| LETTER | 1200 ms | 1100 ms | 1000 ms |
| A4 | 1400 ms | 1300 ms | 1200 ms |
| LGL | 1700 ms | 1600 ms | 1500 ms |
| A5 | 1400 ms | 1300 ms | 1200 ms |

The timing at (1) in FIG. 9 and FIG. 10 indicates a timing at which stapling control is started, and in the case of stapling every 5 prints, the stapling control is started at the timing of (1) every T1×5 prints. As Table 6 indicates, the stapling control is performed for 300 ms from the timing at (1).

TABLE 6

| | Operation time (T2) | Power |
|---|---|---|
| Stapling control | 300 ms | 100 W |
| Replenishing motor driving | 1000 ms | 40 W |

In the example in FIG. 9, the estimated power of the recording material P2 is 860 W (total power of recording material P2 in Table 1). Therefore even if a 100 W power load is applied in the stapling control, Plimit=1000 W is not exceeded, the print interval of T1 (transport interval of recording materials to be continuously fed when image are continuously formed on a plurality of recording materials) need not be increased to prevent power issues.

Further, in the example in FIG. 10, if the stapling operation is started at the timing of (1) in FIG. 10, Plimit=1000 W is exceeded, therefore in this case, the print interval of T1 must be increased to reduce power.

Throughput Adjusting Unit when Print Interval Must be Increased

As described with reference to FIG. 10, 1080 W=980 W+100 W (stapling control) of power is required at the timing of (1) in FIG. 10, hence power supplied for fixing must be reduced by 80 W.

Power prediction in the case of reducing power by increasing the print interval (increasing transport interval of recording materials to be continuously fed when images are continuously formed on a plurality of recording materials) will be described with reference to FIG. 11.

Figure 11:
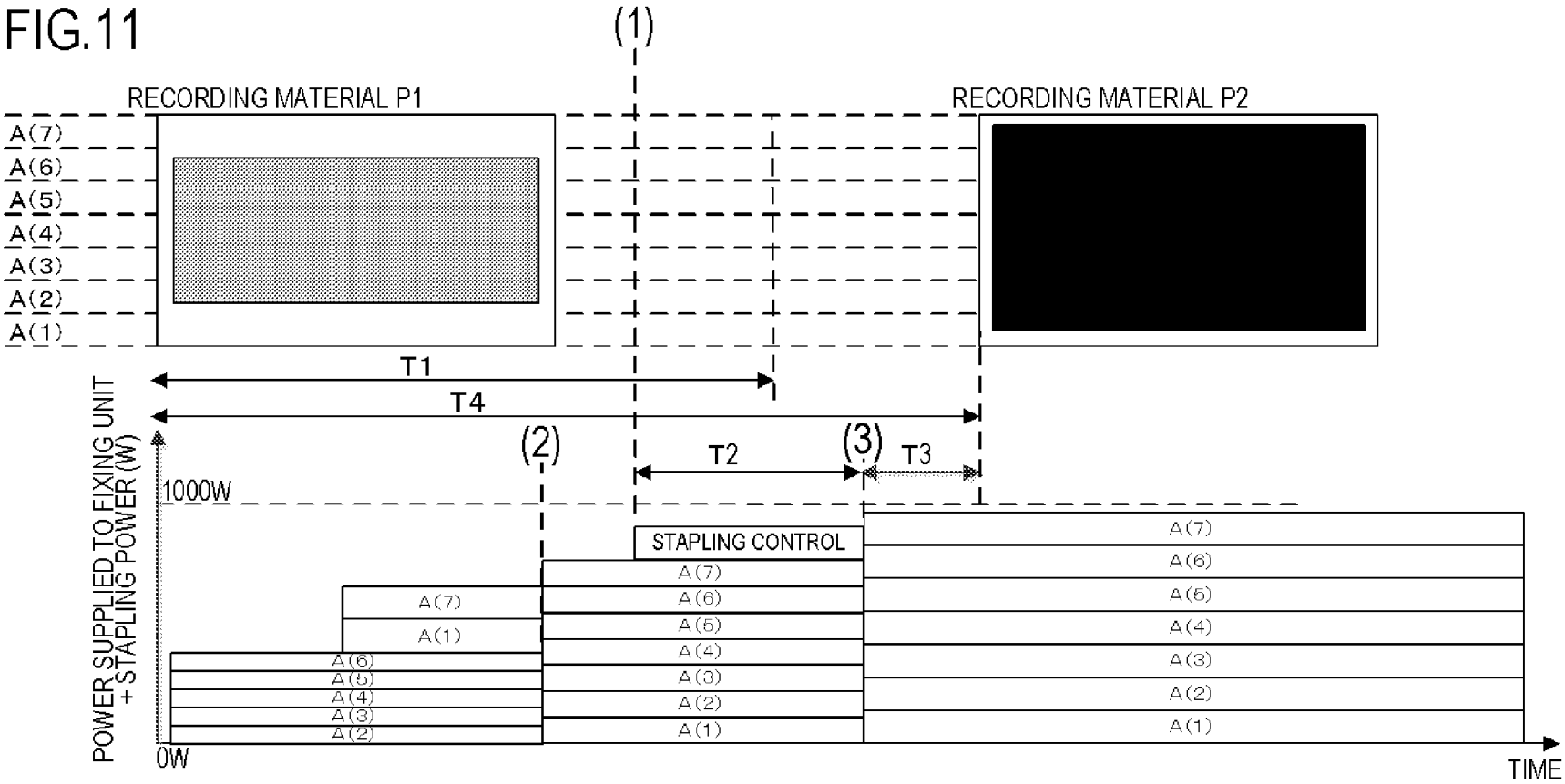
FIG. 11 is a diagram depicting a power prediction when the print interval is increased according to Example 1.

By reducing 20 W from the power that is supposed to be supplied to each heating region A(i) from the timing of (2) in FIG. 11, the stapling control can also be performed. The total of power to be reduced is 140 W=20 W×7, which is a value determined by adding a margin to 80 W. The timing at (2) in FIG. 11 is the after the end timing of the fixing operation, which is performed immediately before the stapling control period T2 (period where the total power exceeds a predetermined power: 1000 W), and before the timing when T2 starts. If the stapling control sends at the timing (3) in FIG. 11, the control temperature is increased to return power to the original power to be supplied. T3 in FIG. 11 is time required for returning the control temperature to the original control temperature, so that a defective image is not generated on the recording material P2. In other words, this is the time required for increasing temperature after the adjustment of power supply in the excess period is cancelled, so as to reach the control target temperature before the recording material P2 reaches the fixing nip portion N. For example, T3 is set based on Table 7, which is a table to indicate a time value in accordance with the insufficient power ΔP. This data indicates data in a specific warmup state of the pressure roller 215 at a specific environment temperature, and is preferably corrected by the scale factors indicated in Table 2.

TABLE 7

| Insufficient power ΔP (W) | T3 time (ms) |
|---|---|
| 20 W ≥ Δ P > 0 W | 100 ms |
| 40 W ≥ Δ P > 20 W | 100 ms |
| 60 W ≥ Δ P > 40 W | 200 ms |
| 80 W ≥ Δ P > 60 W | 200 ms |
| 100 W ≥ Δ P > 80 W | 200 ms |
| Δ P ≥ 100 W | 300 ms |

In Example 1, to reduce 80 W from the power supplied for fixing, power is equally divided and equally reduced from each heating region A(i). However, in order to decrease the T3 time, the warmup state of the pressure roller 215 in each heating region A(i) may be considered so that more power is reduced from the region that is warmer. In other words, the reducing amount of the power may be changed depending on the heating element so that the reducing amount of the power supplied to the heating element, which heats a heating region of which warmup state is predicted to be relatively high, becomes larger than the reducing amount of the power supplied to the other heating elements.

Operation Flow in Example 1

In Example 1, it is assumed that the paper size (recording material size) is "LETTER", the environment temperature is "20° C.", 15 recording materials are continuously printed, and stapling is performed every 5 prints. In Example 1, stapling is performed every 5 prints, therefor stapler is driven a total of three times. At the timings of operating stapler the first time and the second time, the subsequent recording material P has passed the fixing apparatus 21. In Example 1, the timing to operate the stapler for the first time is assumed to be at the timing of (1) indicated in FIG. 9, and between the sixth recording material P and the seventh recording material P. The timing to operate stapling for the second time is assumed to be at the timing indicated in (1) in FIG. 10, and between the eleventh recording material P and the twelfth recording material P. In the timing to operate the stapler for the third time, however, all the recording materials P have exited the fixing apparatus 21, hence power is not supplied to the fixing apparatus 21 at this timing.

Figure 12:
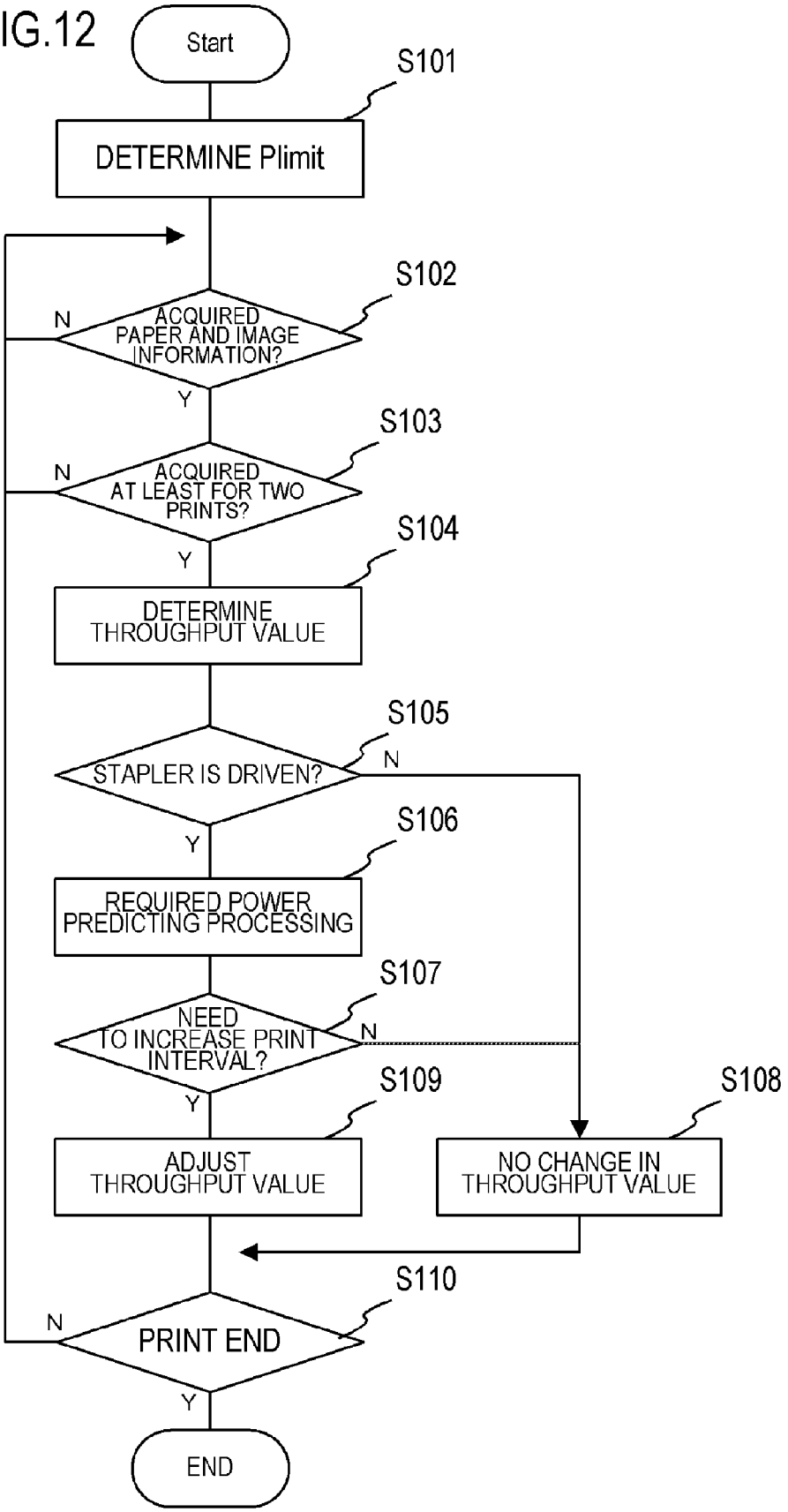
FIG. 12 is an operation flow chart according to Example 1.

FIG. 12 is an operation flow chart of Example 1. When the printer 1 receives a print instruction from a video controller (not illustrated), print preparation starts. In step 101 (S101), the available power for the fixing calculating unit 202 calculates Plimit. As mentioned above, Plimit of Example 1 is 1000 W. In S102, it is checked whether image information and paper information (recording material information) are sent from the video controller for each print. If sent, processing advances to S103. In S103, it is checked whether information that was sent was for at least two prints. When information for the first print and the second print are acquired, processing advances to S104. In S104, the throughput value T1 is determined based on the paper information that is sent. In Example 1, the paper size is "LETTER", and the environment temperature is "20° C.", hence T1 is 1000 ms, as indicated in Table 4. In S105, it is determined whether the stapler is operated.

In S105, it is determined that the stapler is not driven between the first print and the second print, and processing advances to S108. In S108, the current throughput value T1 is stored without any change, and processing advances to S110. In S110, printing continues since there are more images to be acquired, and processing returns to S102. Then in S103, the same operation is performed until information for the fifth print and the sixth print are acquired, hence details thereof are omitted.

When information for the sixth print and the seventh print are acquired in S103, processing advances to S104. In S104, T1 is still assumed to be 1000 ms. In S105, it is determined that the stapler is driven, and processing advances to S106.

In S106, required power is predicted from the image information and warmup level of the sixth and seventh prints, as indicated in FIG. 7. The required power is 980 W for the sixth print, and 860 W for the seventh print, as indicated in Table 1. The stapling control operates for 300 ms and requires 100 W, as indicated in Table 6. In S107, it is determined whether a paper interval increase is required for T1. As indicated in FIG. 9, power is 960 W=860 W×100 W, even if stapling is driven for T2 from the timing of (1) at which the stapler is driven, that is, Plimit is not exceeded. Therefore it is determined that it is necessary to increase the print interval, and processing advances to S108. In S108, the current throughput value T1 is stored without any change, and processing advances to S110. In S110, printing continues since there are still more images to be acquired, and processing returns to S102. Then in S103, the same operation as the first and second prints is performed until information for the tenth and eleventh prints are acquired in S103, hence details thereof are omitted.

When information for the eleventh and twelfth prints are acquired in S103, processing advances to S104. In S104, T1 is still assumed to be 1000 ms. In S105, it is determined that the stapler is driven, and processing advances to S106. In S106, the required power is predicted from the image information and warmup level of the eleventh and twelfth prints, as indicated in FIG. 8. As indicated in Table 4, the required power is 450 W for the eleventh print up to the timing at (2) in FIG. 8, and is 700 W after the timing at (2), and is 980 W for the twelfth print. The stapling control operates for 300 ms and requires 100 W, as indicated in Table 5. In S107, it is determined whether a print interval increase is required for T1. As indicated in FIG. 10, power is 1080 W=980 W+100 W if the stapler is driven for T2 from the timing of (1) at which the stapler is driven, that is, Plimit is exceeded. Therefore it is determined that it is necessary to increase the print interval, and processing advances to S109. In S109, a margin is added to the power exceeding Plimit, so that power to perform stapling is secured. Here 140 W of power is reduced from the fixing power, as mentioned above.

Then the power reducing method is determined. If power is equally reduced from each region A(i), 20 W=140 W/7 is reduced from each region. Then when stapling ends, power to return to the original supply power, and time T3 is returned to the temperature that is sufficient for fixing the twelfth image is predicted. Here 100 ms is predicted, as indicated in Table 7. Then the throughput value is adjusted to T4, so that the twelfth recording material P enters the fixing apparatus 21 at a point when 100 ms has elapsed from the end of the stapling control, as indicated in FIG. 11. After storing the adjusted throughput value, processing advances to S110. In S110, printing continues since there are more images to be acquired, and processing returns to S102. Then in S103, information for the fourteenth and fifteen prints are acquired, and processing ends when there are no more images to be acquired for printing in S110.

According to Example 1, even if a control to apply power load is performed by the stapling operation during printing, a margin of power is calculated from the required power predicted from the image information in each heating element, and an optimum print interval is determined based on the relationship with the newly applied power load. Thereby a drop in throughput can be minimized.

Example 2

The general configuration of the printer 1 according to Example 2 is the same as that of Example 1 in FIG. 1. In Example 2, issues that are not especially described are the same as Example 1.

Hardware Configuration of Image Forming Apparatus

Figure 21:
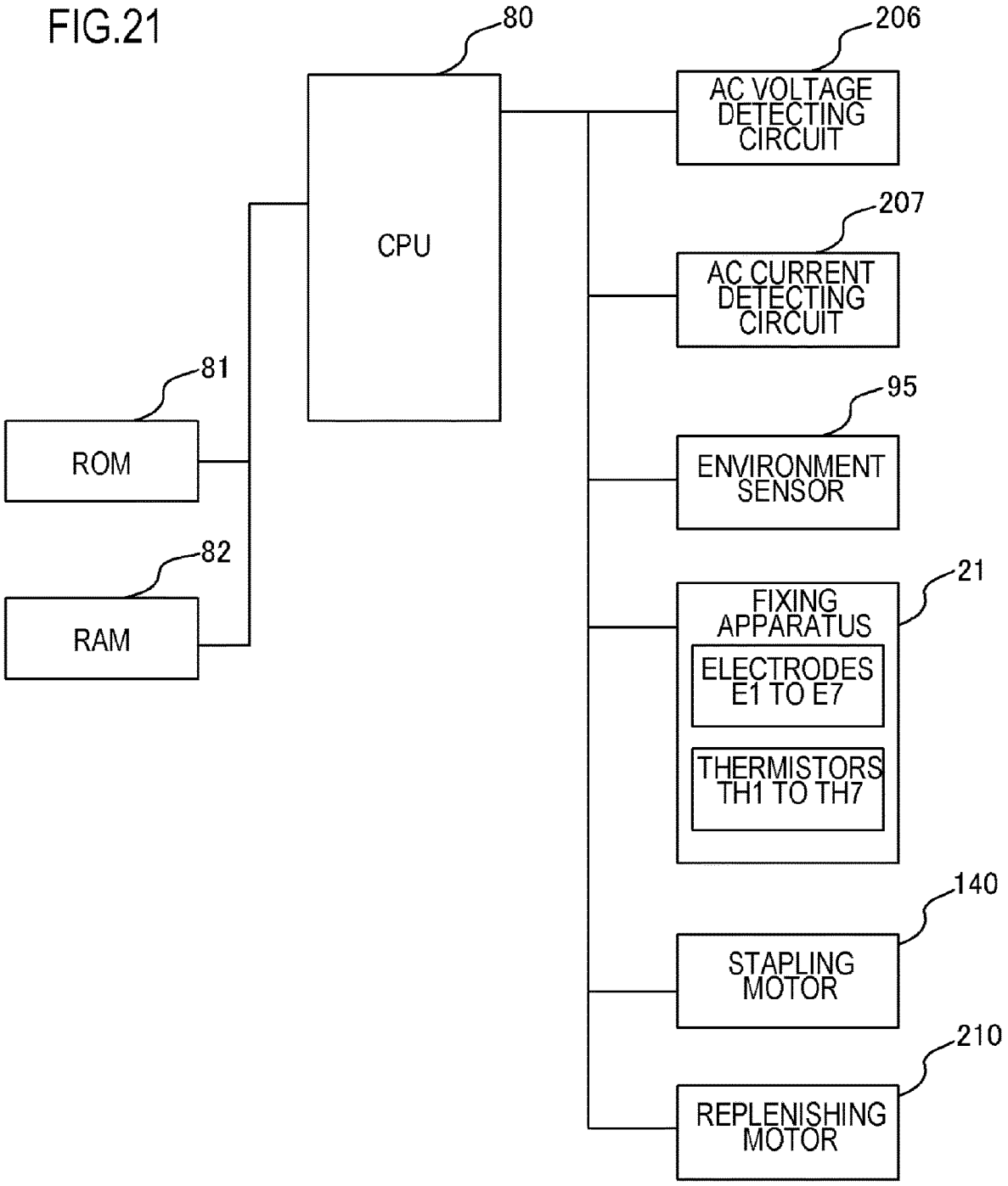
FIG. 21 is a hardware block diagram according to Example 2.

The hardware configuration diagram of Example 2 is generally the same as Example 1 except for a minor difference. As indicated in FIG. 21, the CPU 80 outputs a signal to a motor driving circuit to drive a replenishing motor 210 when toner is replenished.

Configuration of Control Portion of Image Forming Apparatus

The control block diagram of Example 2 is also generally the same as Example 1 except for part a minor difference. Example 2 will be described with reference to FIG. 13, focusing on portions that are different from Example 1.

Figure 13:
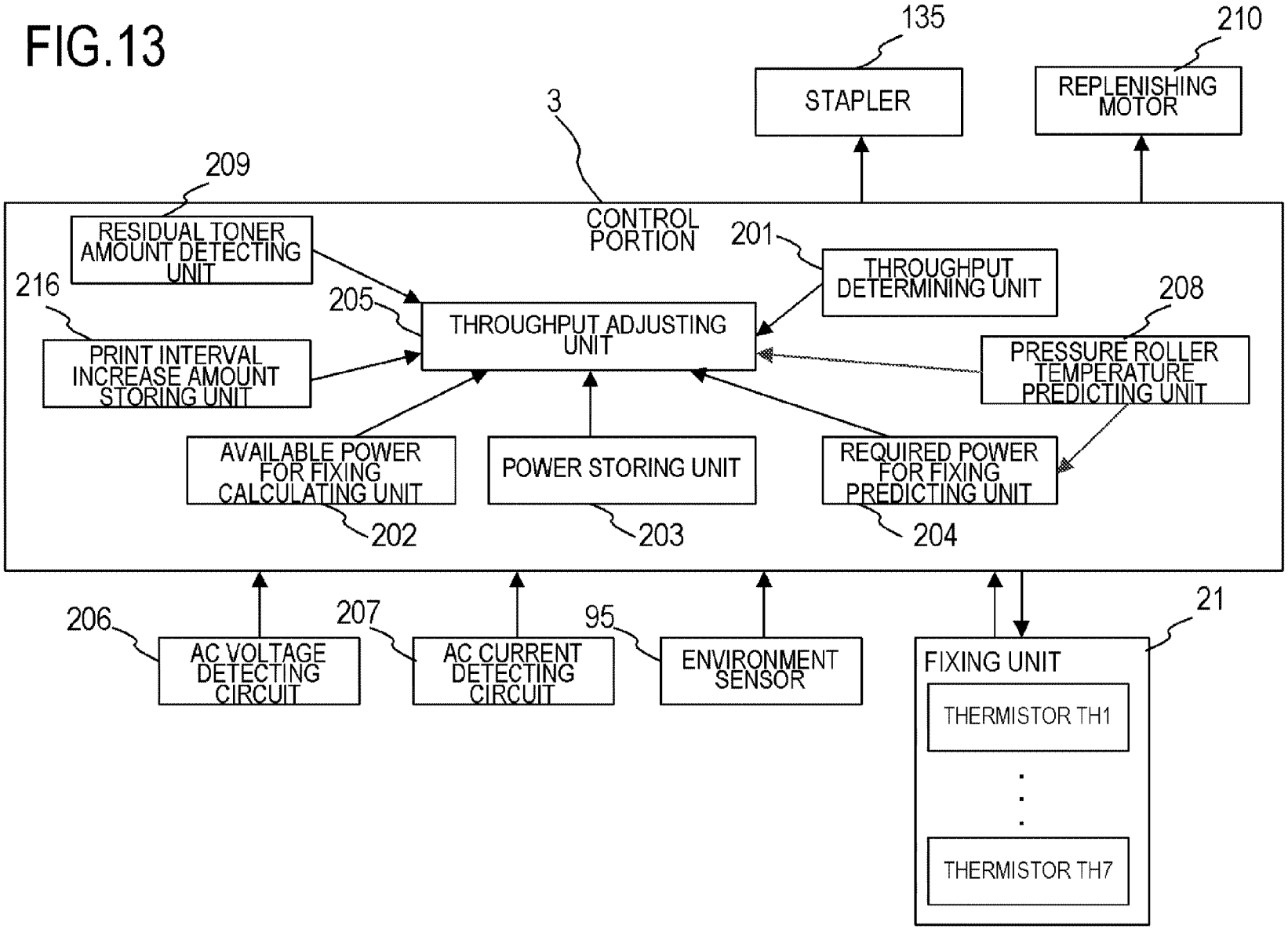
FIG. 13 is a functional block diagram depicting a control portion according to Example 2.

FIG. 13 is a control block diagram according to Example 2. The control block diagram is generally the same as Example 1 in FIG. 6, but the residual toner amount detecting unit 209 and the replenishing motor 210 are different from Example 1.

Residual Toner Amount Detection

The residual toner amount detecting unit 209 may be a known method of detecting the residual toner amount by light transmission. That is, the detection light that is emitted from such an emitting portion as an LED is guided into the toner container via a light guide and a light transmission window disposed on the cartridge of the toner container. The detection light which entered into the toner container exits from the toner container again via the light transmission window, and this transmission of the detection light depends on the conditions including residual toner amount. Then the detection light is guided to a light receiving portion (e.g. phototransistor) disposed in the image forming apparatus main body or the like by the light guide disposed on the toner container. Normally a rotary stirring member, which transports toner toward the developing roller while stirring the toner, is disposed inside the toner container, and the detection light is blocked by the rotation of the stirring member and the toner. As the residual toner amount decreases, the light transmission time increases. By detecting the transmission time of the detection light using this method, the residual toner amount inside the toner container can be estimated and detected.

Another method to detect the residual toner amount is to count a number of pixels of Y, M, C and K respectively when an image is processed. By measuring the toner amount per pixel in advance, and calculating the toner amount based on the number of pixels, the consumed toner amount can be managed. Both methods may be used to detect the residual toner amount more accurately.

By this detecting unit, the residual toner amount in each cartridge is detected, and the replenishing motor 210 is driven when the residual toner amount reaches a certain threshold or less, so as to replenish toner. In Example 2, consumed toner amount is predicted based on the number of pixels.

Prediction of Required Power for Fixing

Figure 14:
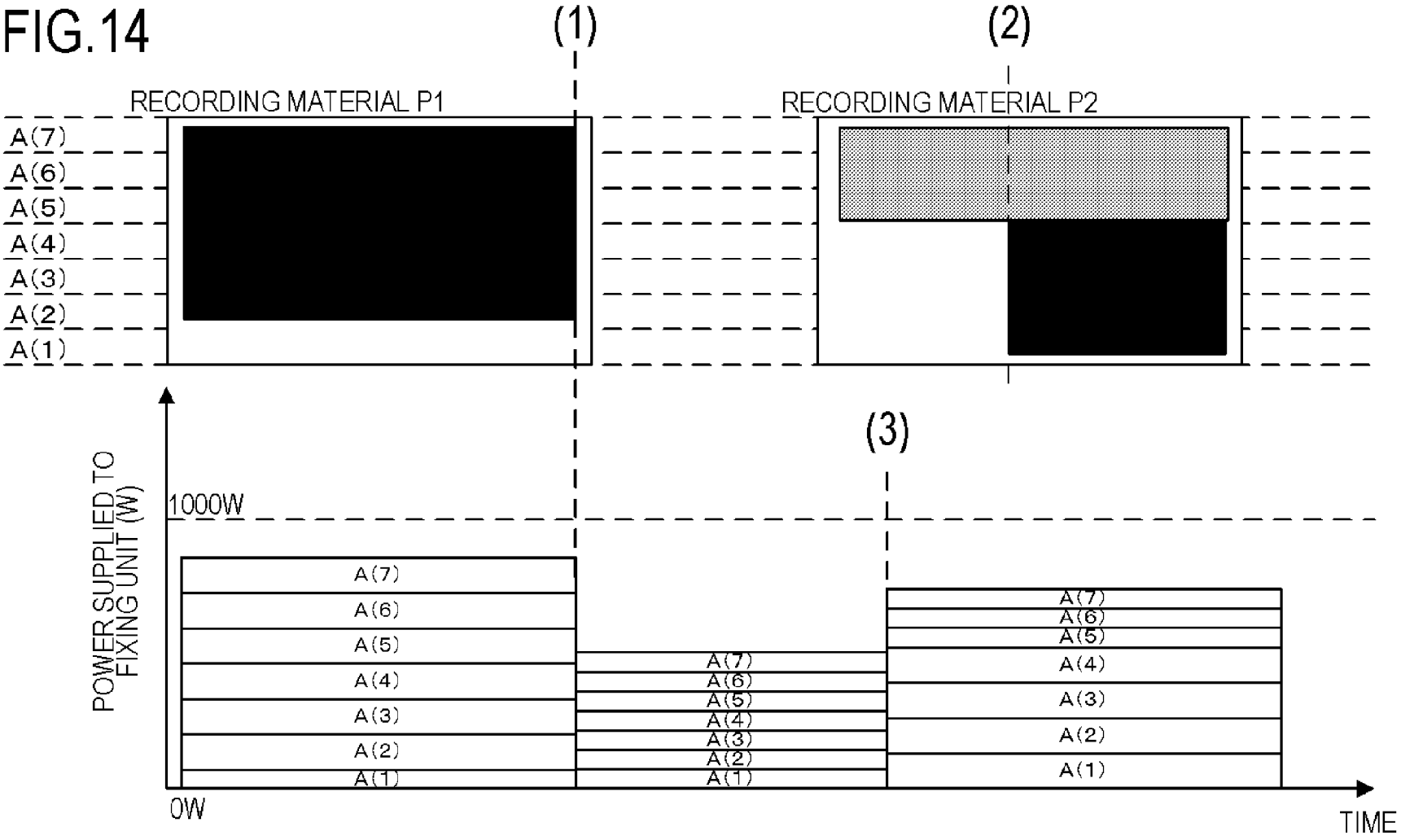
FIG. 14 is a diagram depicting a power prediction example 1 according to Example 2.

A required power for fixing predicting unit 204 will be described with reference to FIG. 14. FIG. 14 indicates the power prediction in the case when the recording materials P1 and P2 are continuously fed. The lower part of FIG. 14 indicates a prediction of power that is supplied to the fixing apparatus 21, from the entry of the recording material P1 to the fixing apparatus 21 to the exit of the recording material P2 from the fixing apparatus 21 (fixing nip portion N). The ordinate indicates the power that is supplied to the fixing apparatus 21, and the abscissa indicates the elapsed time from the entry of the recording material P1 to the fixing apparatus 21. The upper part of FIG. 14 indicates the paper position, image position and print percentage of the recording materials P1 and P2. The timing at (1) in FIG. 14 indicates a timing at which the rear end of the image on the recording material P1 exits the fixing nip portion N, and at this timing, the control is switched to the control for the next recording material P2. For A(2) to A(4), the image intervals (interval between the image on the previous recording material and the image on the subsequent recording material) is wide, with respect to the front end of the image on the recording material P2, hence control to decrease power is performed. For A(5), A(6) and A(7), control for an image which starts from the front end of the recording material P2 is started. The timing at (2) in FIG. 14 indicates a timing at which the print percentage on the recording material P2 changes, and the timing at (3) in FIG. 14 is a timing to switch the power to be supplied before the print percentage changes at the timing of (2). The timing at (3) must be set to a timing at which a fixing defect is not generated by insufficient temperature.

As indicated in Table 8, in the recording material P1, the average print percentage is 0% in the heating region A(1), and 200% in the heating regions A(2) to A(7). In the recording material P2, the average print percentage is 0% in A(1) to A(4) until the timing at (2) in FIG. 14, and 200% after the timing at (2), and the average print percentage is 100% in A(5), A(6) and A(7). The power values in each case are indicated in Table 8, and the power is switched at the timing of (1) and the timing of (3) in FIG. 14.

In Example 2 as well, the data in Table 8 indicates data in a specific warmup state of the pressure roller 215 at a specific environment temperature, and is preferably corrected by the scale factors in Table 2 indicated in Example 1.

TABLE 8

| | Recording material P1 | | Recording material P2 (Up to (2)) | | Recording material P2 (After (2)) | |
|---|---|---|---|---|---|---|
| | Average print percentage | Power | Average print percentage | | Average print percentage | Power |
| A7 | 200% | 140 W | 100% | 90 W | 100% | 90 W |
| A6 | 200% | 140 W | 100% | 90 W | 100% | 90 W |
| A5 | 200% | 140 W | 100% | 90 W | 100% | 90 W |
| A4 | 200% | 140 W | 0% | 80 W | 200% | 140 W |
| A3 | 200% | 140 W | 0% | 80 W | 200% | 140 W |
| A2 | 200% | 140 W | 0% | 80 W | 200% | 140 W |
| A1 | 0% | 80 W | 0% | 80 W | 200% | 140 W |

Figure 15:
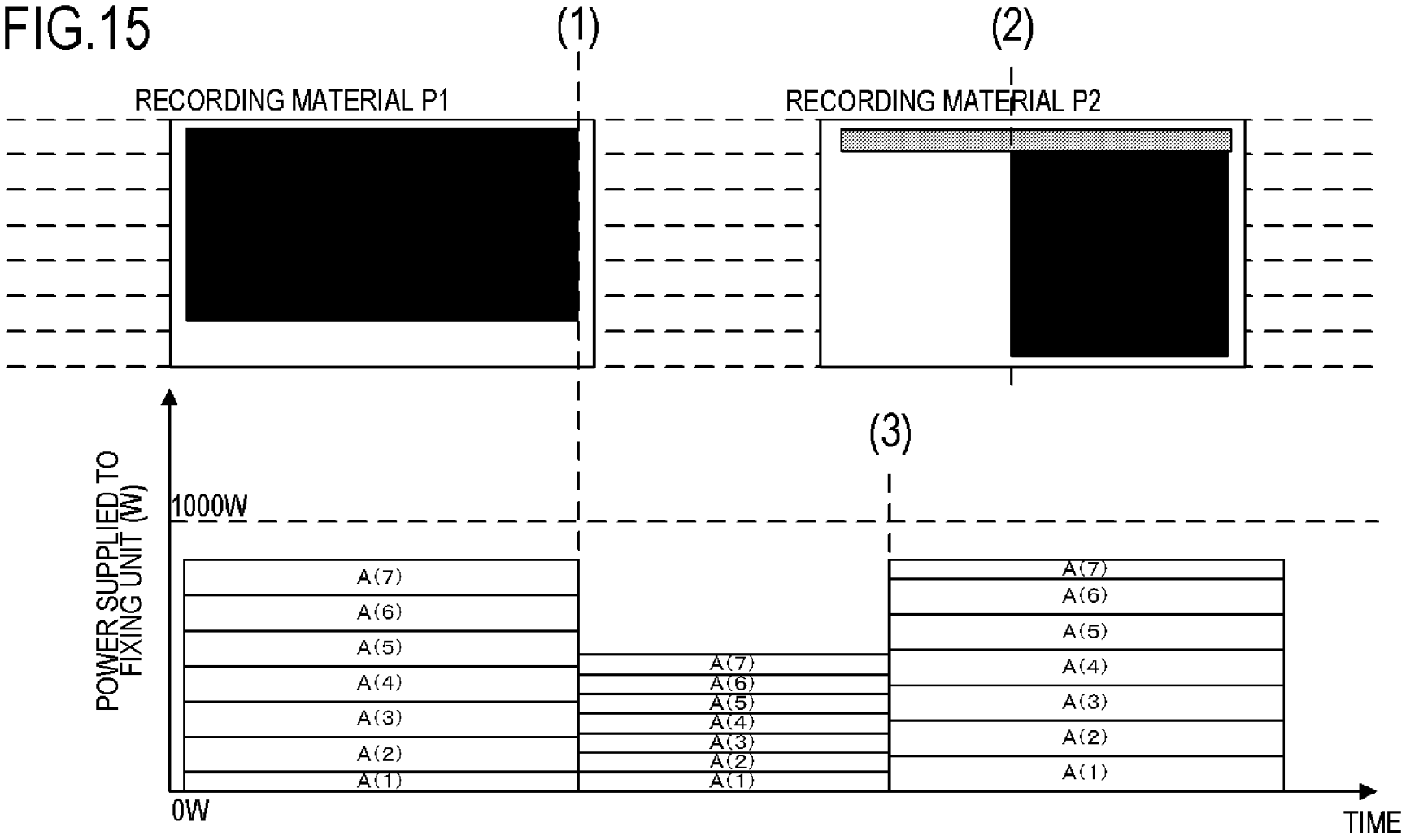
FIG. 15 is a diagram depicting a power prediction example 2 according to Example 2.

FIG. 15 is generally the same as FIG. 14, except for the heating region A(6) of recording material P2. The power values are the same as Table 9.

TABLE 9

| | Recording material P1 | | Recording material P2 (Up to (2)) | | Recording material P2 (After (2)) | |
|---|---|---|---|---|---|---|
| | Average print percentage | Power | Average print percentage | | Average print percentage | Power |
| A7 | 200% | 140 W | 100% | 90 W | 100% | 90 W |
| A6 | 200% | 140 W | 100% | 90 W | 100% | 140 W |
| A5 | 200% | 140 W | 100% | 90 W | 100% | 140 W |
| A4 | 200% | 140 W | 0% | 80 W | 200% | 140 W |
| A3 | 200% | 140 W | 0% | 80 W | 200% | 140 W |
| A2 | 200% | 140 W | 0% | 80 W | 200% | 140 W |
| A1 | 0% | 80 W | 0% | 80 W | 200% | 140 W |

Prediction of Power when Stapler and Replenishing Motor are Operated

The prediction of power, including the stapling operation and the replenishing motor operation, will be described with reference to FIG. 16 and FIG. 17. The lower part of FIG. 16 and FIG. 17 indicates a prediction of power that is supplied to the fixing apparatus 21 and the power that is supplied to the stapler, from the entry of the recording material P1 to the fixing apparatus 21 to the exit of the recording material P2 from the fixing apparatus 21 (fixing nip portion N). The ordinate indicates the total of the power that is supplied to the fixing apparatus 21, power required for stapling, and the power required for driving the replenishing motor, and the abscissa indicates the elapsed time from the entry of the recording material P1 to the fixing apparatus 21. The upper part of the FIG. 16 and FIG. 17 indicates the paper position, image position and print percentage of the recording materials P1 and P2 in this case.

Figure 16:
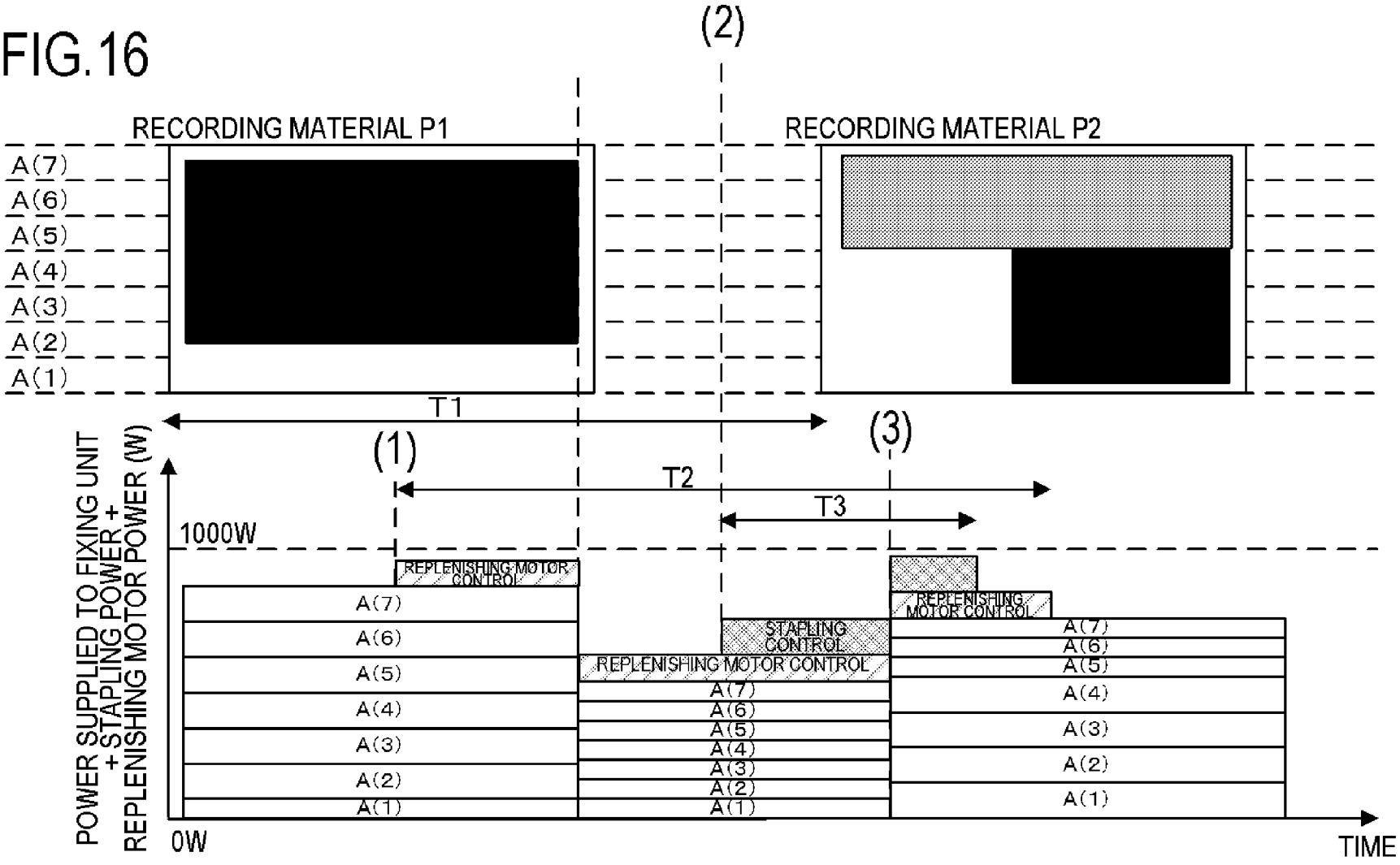
FIG. 16 is a diagram depicting a stapling timing and replenishing motor driving timing example 1 according to Example 2.
Figure 17:
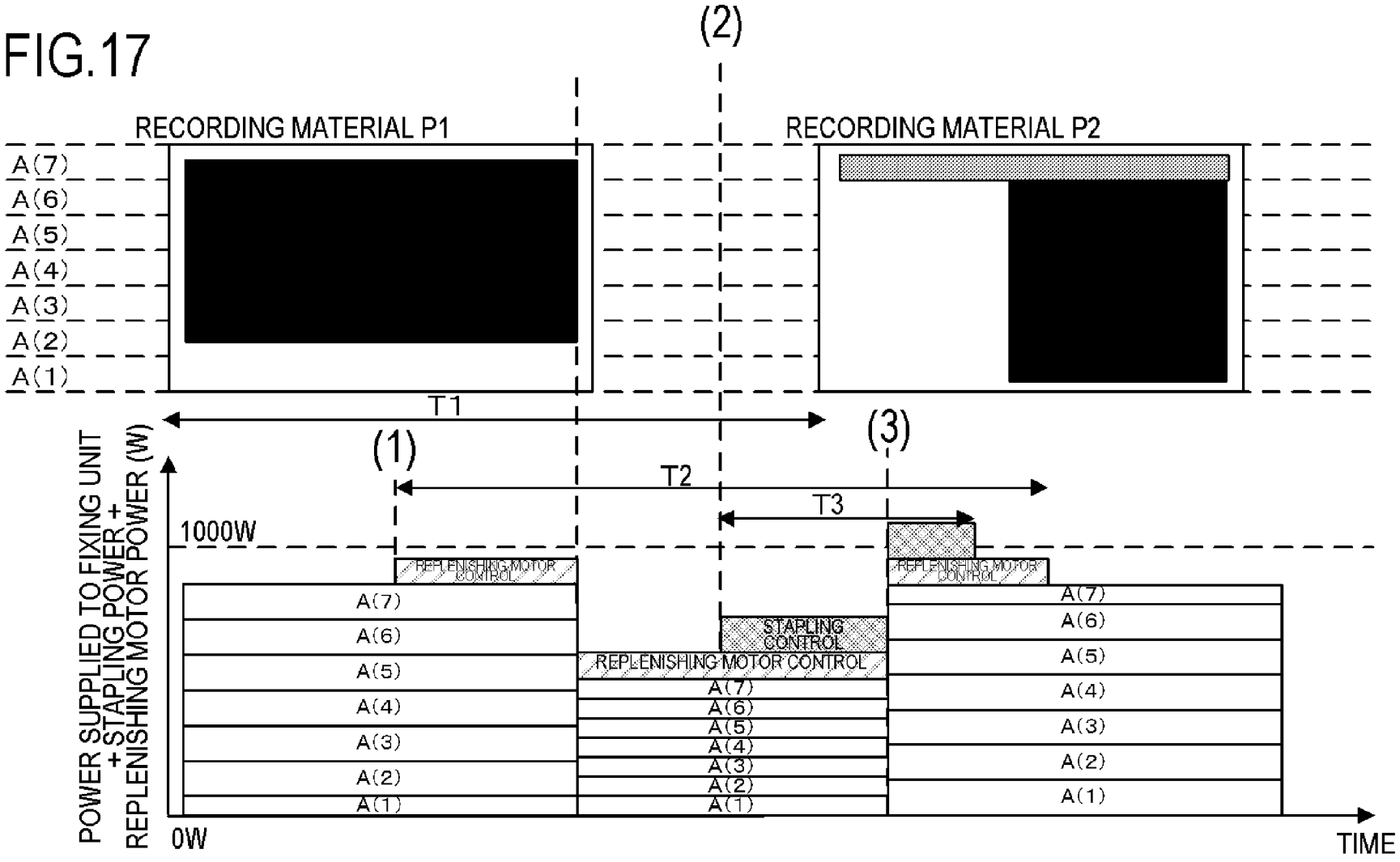
FIG. 17 is a diagram depicting a stapling timing and replenishing motor driving timing example 2 according to Example 2.

As indicated in FIG. 16 and FIG. 17, T1 is a value determined by the throughput determining unit 201, and is determined from the paper size and environment temperature, for example, as indicated in Table 5 of Example 1.

The timing at (1) in FIG. 16 indicates a timing at which driving of the replenishing motor is started, and as indicated in Table 6, the motor is driven for 1000 ms (T2) from the timing at (1).

The timing at (2) in FIG. 16 indicates a timing at which stapling control is started, and in the case of stapling every five prints, the stapling control is started at the timing of (2) every T1×5 prints. As indicated in Table 6, the stapling control is performed for 300 ms (T3) from the timing at (2).

In the example in FIG. 16, power is highest at the timing of (3). The predicted power in this case is 830 W (total power of recording material P2 in Table 8 (after (2))). Therefore even if a 100 W power load is applied in the stapling control, and a 40 W power load is applied in the driving of the replenishing motor, the total is 970 W, and since Plimit=1000 W, the print interval of T1 need not be increased to prevent power issues.

Further, in the example in FIG. 17, power is highest at the timing of (3) in FIG. 17. The predicted power in this case is 930 W (total power of recording material P2 in Table 9 (after (2))), therefore if a 100 W power load is applied in the stapling control and a 40 W power load is applied in the driving of the replenishing motor, the total is 1070 W, which means that in this case, the print interval of T1 must be increased to reduce power.

Throughput Adjusting Unit when Print Interval Must be Increased

As described with reference to FIG. 17, 1070 W of power is required at the timing (1) in FIG. 17, hence the power supplied for fixing must be reduced by 70 W. The power prediction when the print interval is increased to reduce power will be described with reference to FIG. 18.

Figure 18:
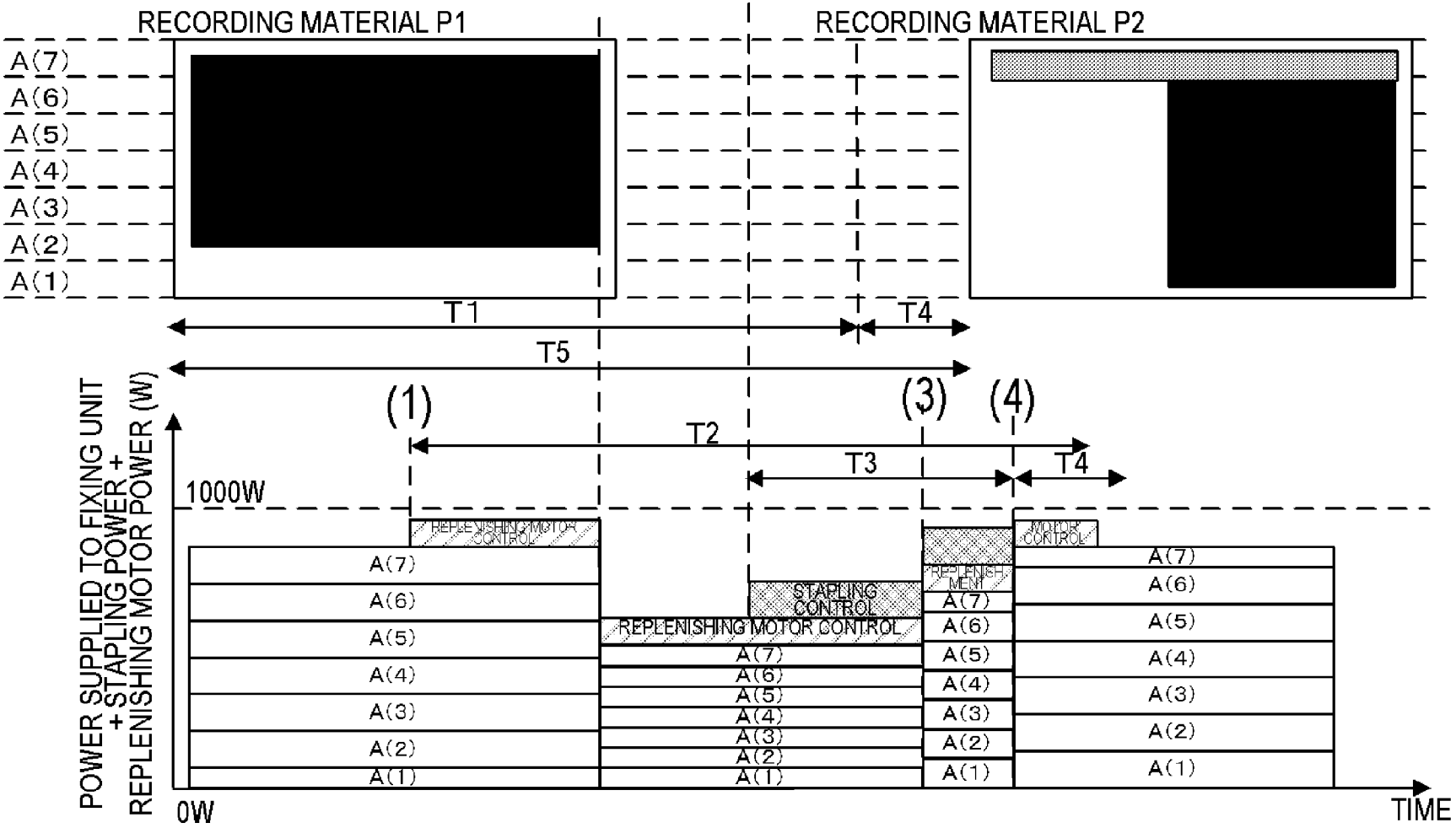
FIG. 18 is a diagram depicting a power prediction when the print interval is increased according to Example 2.

By reducing 20 W from the power that should be supplied to each heating region A(i) from the timing of (3) in FIG. 18, the stapling control can also be performed. The total of power to be reduced is 140 W=20 W×7, which is a value determined by adding a margin to 70 W. Here when the supply power is adjusted in the excess period, the supply power to the heating element corresponding to the heating region A(7) is not changed (amount of reduction is 0), and is the same before and after the adjustment. If the stapling control ends at the timing (4) in FIG. 18, the control temperature is increased to return the power to the original power to be supplied. T4 in FIG. 18 is the time required for returning the control temperature to the original temperature, so that a defected image is not generated on the recording material P2. For example, T4 is determined based on such a table as Table 7 of Example 1, just like Example 1, which is a table to indicate a time value in accordance with the insufficient power ΔP. This data indicates data in a specific warmup state of the pressure roller 215 at a specific environment temperature, and is preferably corrected by the scale factors indicated in Table 2.

Operation Flow in Example 2

In Example 2, it is assumed that the paper size is "LETTER", the environment temperature is "20° C.", 15 recording materials are continuously printed, and the stapler is operated at every 5 prints. In Example 2, the timing to perform the first stapling is at a timing of (2) indicated in FIG. 16, between the sixth recording material P and the seventh recording material P. The second stapling is performed at a timing of (2) indicated in FIG. 17, between the eleventh recording material P and the twelfth recording material P. The third stapling is performed at a timing when power is not supplied to the fixing apparatus 21, since all the recording materials P have exited the fixing apparatus 21.

The timing at which the replenishing motor is driven is determined by predicting the consumed toner amount when each number of pixels of Y, M, C and K, which is sent from the video controller together with the image information, is received. In Example 2, the replenishing motor is driven when the residual toner amount becomes 3% or less. In Example 2, the timing at which the replenishing motor is driven for the first time is the timing of (1) indicated in FIG. 16, between the sixth recording material P and the seventh recording material P. The timing at which the stapler is operated for the second time is the timing (1) indicated in FIG. 17, between the eleventh recording material P and the twelfth recording material P.

Figure 19:
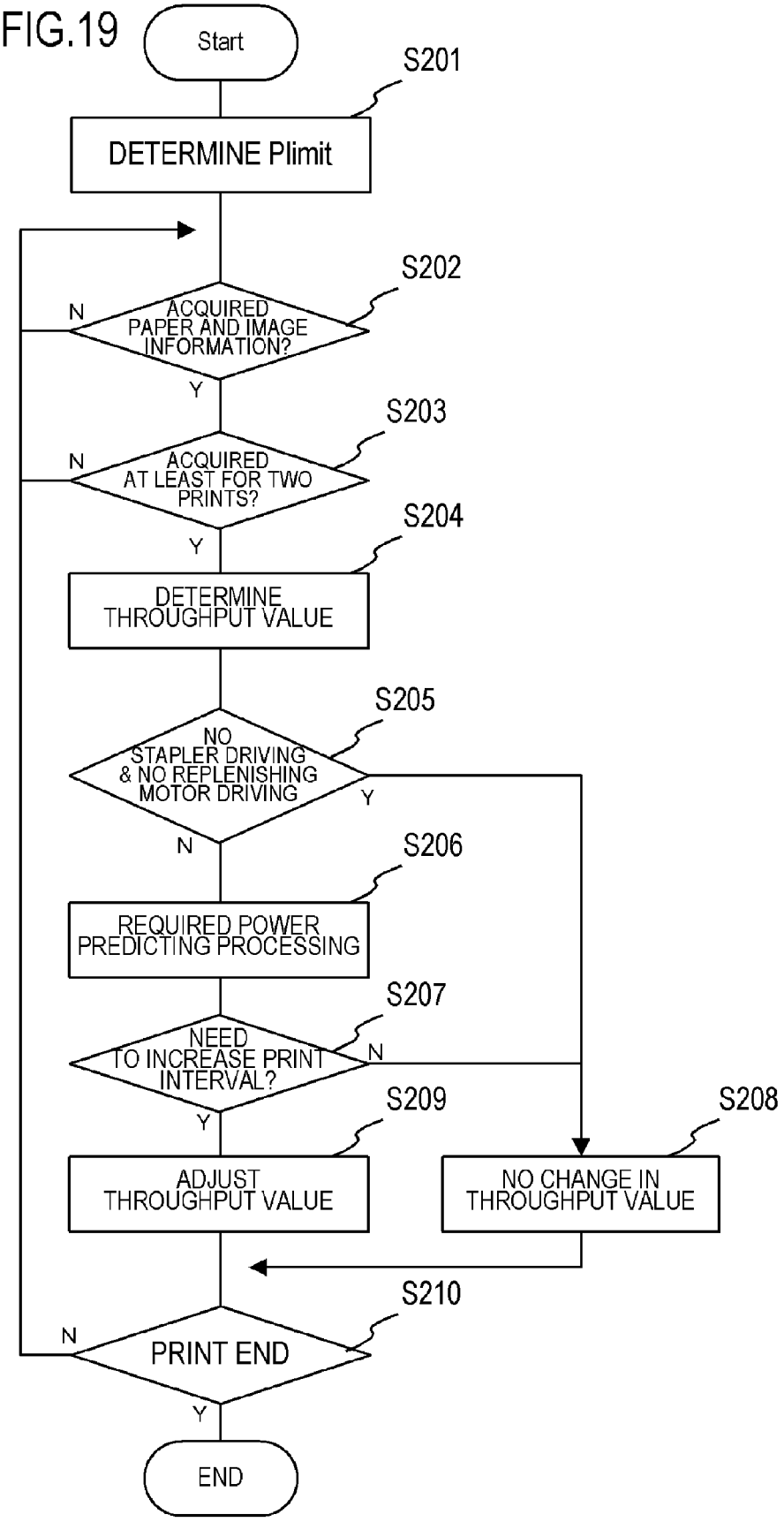
FIG. 19 is an operation flow chart according to Example 2.

FIG. 19 is an operation flow chart of Example 2. When the printer 1 receives a print instruction from the video controller (not illustrated), print preparation starts. In step S201, the available power for fixing calculating unit 202 calculates Plimit. As mentioned above, Plimit of Example 2 is 1000 W. In S202, it is checked whether image information and paper information (recording material information) are sent from the video controller for each print. If sent, processing advances to S203. In S203, it is checked whether information that was sent is for at least two prints. When information for the first print and the second print are acquired, processing advances to S204. In S204, the throughput value T1 is determined based on the paper information that was sent. In Example 2, the paper size is "LETTER" and the environment temperature is "20° C.", hence T1 is 1000 ms, as indicated in Table 5. In S205, it is determined whether the stapler is operated, and whether the replenishing motor is driven.

In S205, it is determined that the stapler is not driven between the first print and the second print. For driving of the replenishing motor, the consumed toner amount is predicted based on the acquired image information. Here the predicted result is assumed to be that the residual amount is: 4% for Y, 50% for M, 40% for C and 4% for K respectively, and in this case, it is determined that the replenishing motor is not driven. Since both the stapler and the replenishing motor are not operated, processing advances to S208. In S208, the current throughput value T1 is stored without any change, and processing advances to S210. In S210, printing continues since there are more images to be acquired, and processing returns to S202. Then in S203, the same operation is performed until information for the fifth print and the sixth print are acquired in S203, hence details thereof are omitted.

When information for the sixth print and the seventh print are acquired in S203, processing advances to S204. In S204, T1 is still assumed to be 1000 ms. In S205, it is determined that the staple is driven. Further, if the result of predicting the consumed toner amount is assumed to be that the residual amount is: 3% for Y, 49% for M, 40% for C and 4% for K, it is determined that the replenishing motor is driven. Since both the stapler and the replenishing motor are operated, processing advances to S206. In S206, stapling control and the driving of the replenishing motor are started between the sixth print and the seventh print, as indicated in FIG. 16. As indicated in Table 8, the power required for the fixing apparatus 21 is 920 W for the sixth print, 590 W for the seventh print up to the timing of (3) in FIG. 16, and is 830 W after the timing of (3). The stapling control operates for 300 ms and requires 100 W, as indicated in Table 6. The replenishing motor, on the other hand, operates for 1000 ms and requires 40 W. In S207, it is determined whether a print interval increase is required for T1. In Example 2, as indicated in FIG. 16, power is 970 W=830 W+100 W (stapling control)+40 W (driving of replenishing motor), even at the timing (3) at which the required power is at the maximum, that is, Plimit is not exceeded. Therefore it is determined that it is unnecessary to increase the print interval, and processing advances to S208. In S208, the current throughput value T1 is stored without any changes, and processing advances to S210. In S210, printing continues since there are more images to be acquired, and processing returns to S202. Then in S203, the same operation as the first and the second prints is performed until information for the tenth and eleventh prints are acquired in S203, hence details thereof are omitted.

When information for the eleventh and twelfth prints are acquired in S203, processing advances to S204. In S204, T1 is still assumed to be 1000 ms. In S205, it is determined that the stapler is driven. Further, if the result of predicting the consumed toner amount is assumed to be that the residual amount is: 100% for Y, 49% for M, 39% for C and 3% for K, it is determined that the replenishing motor is driven. Since both the stapler and the replenishing motor are operated, processing advances to S206. In S206, the stapling control and the driving of the replenishing motor are started between the eleventh print and the twelfth print, as indicated in FIG. 17. As indicated in Table 9, the power required for the fixing apparatus 21 is 920 W for the eleventh print, 590 W for the twelfth print up to the timing at (3) in FIG. 16, and is 930 W after the timing at (3). The stapling control operates for 300 ms and requires 100 W, as indicated in Table 6. The replenishing motor operates for 1000 ms and requires 40 W. In S207, it is determined whether a print interval increase is required for T1. As indicated in FIG. 17, power is 1070 W=930 W+100 W (stapling control)+40 W (driving of replenishing motor) at the timing of (3) at which the required power is at the maximum, that is, Plimit is exceeded. Therefore it is determined that it is necessary to increase the print interval, and processing advances to S209. In S209, a margin is added to the power exceeding Plimit, so that power to drive the stapler and the replenishing motor is secured. Here 140 W of power is reduced from the fixing power, as mentioned above.

If the power is equally reduced from each region A(i), 20 W=140 W/7 is reduced from each region. Then at the timing of (3), the original power to be supplied to the fixing apparatus 21 is reduced, and power is returned to the original power supply at the timing of (4) when stapling ends, as indicated in FIG. 18. Time T4, which is required for returning the control temperature to the original control temperature after the timing of (4), so that a defected image is not generated on the recording material P2, is predicted to 100 ms, as indicated in table 7. Then as indicated in FIG. 18, a value T5, determined by adding T4 to the throughput value T1, is stored as the adjusted throughput value, and processing advances to S210. In S210, printing is continued since there are more images to be acquired, and processing returns to S202. Then in S203, information on the fourteenth and fifteenth prints are acquired, and processing ends when there are no more images to be acquired for printing in S210.

According to Example 1, even if a power load is applied by driving a plurality of actuators during printing, a margin of power is calculated from the required power predicted from the image information in each heating element, and the optimum print interval is determined based on the relationship with the newly applied power load. Thereby a drop in throughput can be minimized.

The configurations of the above examples may be combined with each other as often as possible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-096657, filed on May 18, 2018, which is hereby incorporated by reference herein in its entirety.

What is claimed is:

1. An image forming apparatus comprising:

an image forming portion which is configured to form an image on a recording material;

a fixing portion which includes a heater constituted of a plurality of heating elements disposed in a direction orthogonal to a transport direction of a recording material, and is configured to fix the image on the recording material using heat of the heater; and a power control unit which is configured to be capable of controlling power supplied to the plurality of heating elements individually based on image information of an image formed on a recording material, wherein the image forming apparatus further comprises:

an interval determining unit that is configured to determine a transport interval of a plurality of recording materials in the case of continuous feeding in which images are continuously formed on the plurality of recording materials and the images are continuously heated;

an actuator which is configured to operate during the continuous feeding;

a power predicting unit which is configured to predict power required for controlling the temperature of a plurality of heating regions heated by the plurality of heating elements to a predetermined target temperature based on the image information;

a power storing unit which is configured to store power required for operating the actuator; and an adjusting unit which is configured for adjusting the power supplied to the plurality of heating elements by the power control unit, and the transport interval determined by the interval determining unit, wherein when an excess period, which is a period in which the total of the power predicted by the power predicting unit and power stored by the power storing unit exceeds a predetermined power, exists during continuous feeding, the adjusting unit: (i) at least during the excess period, adjusts power supplied to the plurality of heating elements by the power control unit, so that the total of the power supplied to the plurality of heating elements and the power stored by the power storing unit does not exceed the predetermined power, and (ii) after the excess period, adjusts the transport interval so that the temperature rising to a target temperature in the plurality of heating regions by supplying power to the plurality of heating regions in which the adjustment of the power supply is cancelled, is completed before the arrival of the recording material to the fixing portion.

2. The image forming apparatus according to claim 1, wherein the adjustment of the power supply is started before the timing when the excess period starts.

3. The image forming apparatus according to claim 1, wherein the adjusting unit is configured to adjust the transport interval so that the transport interval determined by the interval determining unit is increased.

4. The image forming apparatus according to claim 1, wherein the fixing portion includes a heating member having the heater, and a pressing member which is configured to press-contact the heating member and form a nip portion, wherein the image forming apparatus further includes a predicting unit which is configured to predict a warmup state of the pressing member for each of a plurality of regions of the pressing member corresponding to the plurality of heating regions, and wherein in the adjustment of the power supply, the adjusting unit sets the amount of reduction in power supplied to a heating element for heating a heating region, which corresponds to a region of the pressing member in which the predicting unit predicted that the warmup state is relatively high, to be higher than the amount of reduction in power supplied to the other heating elements among the plurality of heating elements.

5. The image forming apparatus according to claim 1, wherein in the adjustment of the power supply, the adjusting unit is configured to adjust the power supply so that levels of power supplied to a part of the plurality of heating elements are not changed.

6. The image forming apparatus according to claim 1, wherein the adjusting unit adjusts the power supply so that the levels of the adjusted power to be supplied to the plurality of heating elements are equal to one another.

7. The image forming apparatus according to claim 1, wherein the image information includes print percentages of a plurality of divided regions of the recording material corresponding to the plurality of heating regions.

8. The image forming apparatus according to claim 1, wherein the image information includes a position of the image in each of the plurality of divided regions of the recording material corresponding to the plurality of heating regions.

9. The image forming apparatus according to claim 1, wherein the interval determining unit is configured to determine the transport interval based on the size or weight of the recording material.

10. The image forming apparatus according to claim 1, wherein the interval determining unit is configured to determine the transport interval based on the environment temperature or environment humidity.

11. The image forming apparatus according to claim 1, wherein the fixing portion further includes a tubular film and the heater contacts the inner surface of the film.

* * * * *